US005215838A

United States Patent [19]

Tam et al.

[11] Patent Number: 5,215,838

[45] Date of Patent: Jun. 1, 1993

[54] INFRARED OR RED LIGHT SENSITIVE MIGRATION IMAGING MEMBER

[75] Inventors: Man C. Tam, Mississauga; Judith P. Meester, Waterloo; Hany M. Aboushaka, Toronto; Rafik O. Loutfy, Willowdale, all of Canada; Gregory J. Kovacs, Sunnyvale, Calif.; Carol A. Jennings, Mississauga, Canada

[73] Assignee: Xerox Corporation, Stamford, Conn.

[21] Appl. No.: 771,910

[22] Filed: Oct. 4, 1991

[51] Int. Cl.[5] ..... G03G 13/00; G03G 5/026

[52] U.S. Cl. ..... 430/41; 430/31; 430/126

[58] Field of Search ..... 430/41, 58, 126

[56] References Cited

U.S. PATENT DOCUMENTS

| | | | |
|---|---|---|---|
| 4,123,283 | 10/1978 | Goffe | 96/1 PS |
| 4,536,457 | 8/1985 | Tam | 430/41 |
| 4,536,458 | 8/1985 | Ng | 430/41 |
| 4,853,307 | 8/1989 | Tam et al. | 430/41 |
| 4,880,715 | 11/1989 | Tam et al. | 430/41 |
| 4,883,731 | 11/1989 | Tam et al. | 430/41 |
| 4,970,130 | 11/1990 | Tam et al. | 430/41 |
| 5,021,318 | 6/1991 | Mayo et al. | 430/124 |

*Primary Examiner*—Marion E. McCamish
*Assistant Examiner*—Rosemary Ashton
*Attorney, Agent, or Firm*—Judith L. Byorick

[57] ABSTRACT

Disclosed is a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

46 Claims, 16 Drawing Sheets

INFRARED OR RED LIGHT SENSITIVE MIGRATION IMAGING MEMBER

BACKGROUND OF THE INVENTION

The present invention is directed to a migration imaging member. More specifically, the present invention is directed to a migration imaging member capable of being imaged by exposure to infrared or red light radiation. One embodiment of the present invention is directed to a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer. Another embodiment of the present invention is directed to a xeroprinting master which comprises a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, wherein a portion of the migration marking material has migrated through the softenable layer toward the substrate in imagewise fashion. Yet another embodiment of the present invention is directed to a migration imaging process employing the migration imaging member of the present invention. The imaging process comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; and (5) subsequent to steps 3 and 4, causing the softenable material to soften, thereby enabling the migration marking material to migrate through the softenable material toward the substrate in an imagewise pattern. Still another embodiment of the present invention is directed to a xeroprinting process employing the imaged migration imaging member of the present invention as a xeroprinting master. The process comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; (5) subsequent to steps 3 and 4, causing the softenable material to soften, thereby enabling the migration marking material to migrate through the softenable material toward the substrate in an imagewise pattern; (6) subsequent to step 5, uniformly charging the imaging member; (7) subsequent to step 6, uniformly exposing the charged member to activating radiation, thereby forming an electrostatic latent image; (8) subsequent to step 7, developing the electrostatic latent image; and (9) subsequent to step 8, transferring the developed image to a receiver sheet.

Migration imaging systems capable of producing high quality images of high optical contrast density and high resolution have been developed. Such migration imaging systems are disclosed in, for example, U.S. Pat. Nos. 3,975,195 (Goffe), 3,909,262 (Goffe et al.), 4,536,457 (Tam), 4,536,458 (Ng), 4,013,462 (Goffe et al.), and "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosures of each of which are totally incorporated herein by reference. Migration imaging members containing charge transport materials in the softenable layer are also known, and are disclosed, for example, in U.S. Pat. Nos. 4,536,457 (Tam) and 4,536,458 (Ng). In a typical embodiment of these migration imaging systems, a migration imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material is originally in the form of a fracturable layer contiguous with the upper surface of the softenable layer, the marking particles in the exposed area of the member migrate in depth toward the substrate when the member is developed by softening the softenable layer.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. Nos. 4,536,458 (Ng) and 4,536,457 (Tam).

U.S. Pat. No. 4,536,458 (Ng) discloses a migration imaging member comprising a substrate and an electrically insulating softenable layer on the substrate, the softenable layer comprising migration marking material located at least at or near the surface of the softenable layer spaced from the substrate, and a charge transport molecule. The migration imaging member is electrostatically charged, exposed to activating radiation in an imagewise pattern, and developed by decreasing the resistance to migration, by exposure either to solvent vapor or heat, of marking material in depth in the softenable layer at least sufficient to allow migration of marking material whereby marking material migrates toward the substrate in image configuration. The preferred thickness of the softenable layer is about 0.7 to 2.5 microns, although thinner and thicker layers can also be utilized.

U.S. Pat. No. 4,536,457 (Tam) discloses a process in which a migration imaging member comprising a substrate and an electrically insulating softenable layer on the substrate, the softenable layer comprising migration marking material located at least at or near the surface of the softenable layer spaced from the substrate, and a charge transport molecule (e.g. the imaging member described in U.S. Pat. No. 4,536,458) is uniformly charged and exposed to activating radiation in an imagewise pattern. The resistance to migration of marking material in the softenable layer is thereafter decreased sufficiently by the application of solvent vapor to allow the light exposed particles to retain a slight net charge to prevent agglomeration and coalescence and to allow slight migration in depth of marking material towards the substrate in image configuration, and the resistance to migration of marking material in the softenable layer is further decreased sufficiently by heating to allow non-exposed marking material to agglomerate and coalesce. The preferred thickness is about 0.5 to 2.5 microns, although thinner and thicker layers can be utilized.

Migration imaging members have been used as xeroprinting masters for printing and duplicating applications.

U.S. Pat. No. 4,880,715 (Tam et al.), the disclosure of which is totally incorporated by reference, discloses a xeroprinting process wherein the xeroprinting master is a developed migration imaging member wherein a charge transport material is present in the softenable layer and non-exposed marking material in the softenable layer is caused to agglomerate and coalesce. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member. The contrast voltage of the electrostatic latent image obtainable from this process generally initially increases with increasing flood exposure light intensity, typically reaches a maximum value of about 60 percent of the initially applied voltage and then decreases with further increase in flood exposure light intensity. The light intensity for the flood exposure step thus generally must be well controlled to maximize the contrast potential.

U.S. Pat. No. 4,853,307 (Tam et al.), the disclosure of which is totally incorporated herein by reference, discloses a migration imaging member containing a copolymer of styrene and ethyl acrylate in at least one layer adjacent to the substrate. When developed, the imaging member can be used as a xeroprinting master. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member.

U.S. Pat. No. 4,970,130 (Tam et al.), the disclosure of which is totally incorporated herein by reference, discloses a xeroprinting process which comprises (1) providing a xeroprinting master comprising (a) a substrate and (b) a softenable layer comprising a softenable material, a charge transport material capable of transporting charges of one polarity and migration marking material situated contiguous to the surface of the softenable layer spaced from the substrate, wherein a portion of the migration marking material has migrated through the softenable layer toward the substrate in imagewise fashion; (2) uniformly charging the xeroprinting master to a polarity opposite to the polarity of the charges that the charge transport material in the softenable layer is capable of transporting; (3) uniformly exposing the charged master to activating radiation, thereby discharging those areas of the master wherein the migration marking material has migrated toward the substrate and forming an electrostatic latent image; (4) developing the electrostatic latent image; and (5) transferring the developed image to a receiver sheet. The process results in greatly enhanced contrast potentials or contrast voltages between the charged and uncharged areas of the master subsequent to exposure to activating radiation, and the charged master can be developed with either liquid developers or dry developers. The contrast voltage of the electrostatic latent image obtainable from this process generally initially increases with increasing flood exposure light intensity, typically reaches a plateau value of about 90 percent of the initially applied voltage even with further increase in flood exposure light intensity.

U.S. Pat. No. 4,123,283 (Goffe), the disclosure of which is totally incorporated herein by reference, discloses a migration layer comprising migration material and softenable material, the migration layer having a net electrical latent image. The process of setting the electrical latent image comprises providing an imaging member comprising the migration layer, electrically latently imaging the migration layer, and setting the electrical latent image by either storing the migration layer in the dark or applying heat, applying vapor, or applying partial solvents in a predevelopment softening step. After setting of the electrical latent image, the migration layer can be exposed to activating electromagnetic radiation, such as incandescent lamps, x-rays, beams of charged particles, infrared radiation, ultraviolet radiation, and the like, as well as combinations thereof, without loss of the latent image and permitted long delays of up to years between formation of the electrical latent image and the development step which allows selective migration in depth.

U.S. Pat. No. 4,883,731 (Tam et al.), the disclosure of which is totally incorporated herein by reference, discloses an imaging system in which an imaging member comprising a substrate and an electrically insulating softenable layer on the substrate, the softenable layer comprising migration marking material locked at least at or near the surface of the softenable layer spaced from the substrate, and a charge transport material in the softenable layer is imaged by electrostatically charging the member, exposing the member to activating radiation in an imagewise pattern, and decreasing the resistance to migration of marking material in the softenable layer sufficiently to allow the migration marking material struck by activating radiation to migrate substantially in depth towards the substrate in image configuration. The imaged member can be used as a xeroprinting master in a xeroprinting process comprising uniformly charging the master, uniformly exposing the charged master to activating illumination to form an electrostatic latent image, developing the latent image to form a toner image, and transferring the toner image to a receiving member. A charge transport spacing layer comprising a film forming binder and a charge transport compound may be employed between the substrate and the softenable layer to increase the contrast potential associated with the surface charges of the latent image.

While known imaging members and imaging processes are suitable for their intended purposes, a need remains for migration imaging members that can be imaged by exposure to infrared or red light radiation. The ability to image the member with infrared or red light radiation enables the use of the member in laser imaging systems employing relatively inexpensive diode lasers. In contrast, migration imaging members employing, for example, pure selenium particles as the migration marking material, which particles are photosensitive primarily in the blue or green wavelength range, require the use of relatively expensive argon ion lasers as the imaging source. In addition, a need remains for migration imaging members that are suitable for imaging by infrared or red light radiation exposure followed by heat development. While some migration imaging members, such as those with selenium-tellurium alloy migration marking material, can be imaged by exposure to infrared radiation, these members generally must be developed by vapor or solvent methods instead of by heat development. Heat development generally is preferred to vapor or solvent development for reasons of safety, speed, cost, simplicity, and solvent recovery difficulties.

SUMMARY OF THE INVENTION

It is an object of the present invention to provide improved migration imaging members possessing photosensitivity to infrared and/or red light radiation.

It is another object of the present invention to provide improved migration imaging members that possess photosensitivity to infrared and/or red light radiation and allow imaging using heat development.

It is yet another object of the present invention to provide migration imaging processes for imaging the improved migration imaging member using either infrared or red radiation and heat development to produce excellent optically sign-reversed migration images.

It is still another object of the present invention to provide migration imaging processes for imaging the improved migration imaging member of the present invention by exposure to blue/green light radiation followed by heat development to produce excellent optically sign-retained migration images.

Another object of the present invention is to provide xeroprinting processes that employ the improved migration imaging member as a xeroprinting master to produce high quality prints.

Yet another object of the present invention is to provide an improved xeroprinting master which is produced by exposure to infrared and/or red light radiation and which provides the high voltage contrast desired for xerographic development of the electrostatic latent image.

These and other objects of the present invention (or specific embodiments thereof) can be achieved by providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer. Either the softenable layer or the infrared or red light radiation sensitive layer can be in contact with the substrate or with an optional charge blocking layer. Another embodiment of the present invention is directed to a xeroprinting master which comprises a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, wherein a portion of the migration marking material has migrated through the softenable layer toward the substrate in imagewise fashion. Another embodiment of the present invention is directed to a migration imaging process employing the migration imaging member of the present invention which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; and (5) subsequent to steps 3 and 4, causing the softenable material to soften, thereby enabling the migration marking material to migrate through the softenable material toward the substrate in an imagewise pattern. Yet another embodiment of the present invention is directed to a xeroprinting process employing the imaged migration imaging member of the present invention as a xeroprinting master. The process comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; (5) subsequent to steps 3 and 4, causing the softenable material to soften, thereby enabling the migration marking material to migrate through the softenable material toward the substrate in an imagewise pattern; (6) subsequent to step 5, uniformly charging the imaging member; (7) subsequent to step 6, uniformly exposing the charged member to activating radiation, thereby forming an electrostatic latent image; (8) subsequent to step 7, developing the electrostatic latent image; and (9) subsequent to step 8, transferring the developed image to a receiver sheet. Still another embodiment of the present invention is directed to a migration imaging process employing the migration imaging member of the present invention which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to radiation at a wavelength to which the migration marking material is sensitive in an imagewise pattern, thereby forming an electrostatic latent image on the imaging member; and (4) subsequent to step 3, causing the softenable material to soften, thereby enabling the migration marking material to migrate through the softenable material toward the substrate in an imagewise pattern. Yet another embodiment of the present invention is directed to a xeroprinting process employing the imaged migration imaging member of the present invention as a xeroprinting master. The process comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to radiation at a wavelength to which the migration marking material is sensitive in an imagewise pattern, thereby forming an electrostatic latent image on the imaging member; (4) subsequent to step 3, causing the softenable material to soften, thereby enabling the migration marking material to migrate through the softenable material toward the substrate in an imagewise pattern; (5) subsequent to step 4, uniformly charging the imaging member; (6) subsequent to step 5, uniformly exposing the charged member to activating radiation, thereby forming an electrostatic latent image; (7) subsequent to step 6, developing the electrostatic latent image; and (8) subsequent to step 7, transferring the developed image to a receiver sheet.

DETAILED DESCRIPTION OF THE INVENTION

The migration imaging member of the present invention comprises a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is sensitive contained at or near the surface of the softenable layer. Either the softenable layer or the infrared sensitive layer can be in contact with the substrate or with an optional charge blocking layer.

Figure 1:
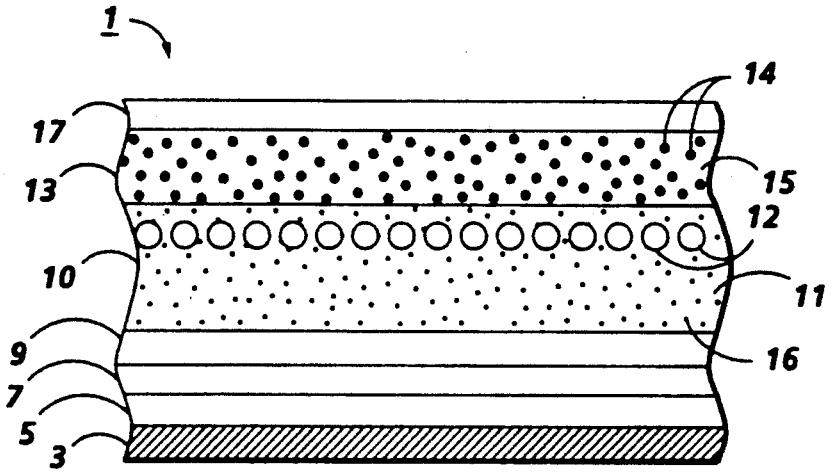
FIGS. 1 and 2 illustrate schematically migration imaging members of the present invention.

As illustrated schematically in FIG. 1, migration imaging member 1 comprises in the order shown a substrate 3, an optional adhesive layer 5 situated on substrate 3, an optional charge blocking layer 7 situated on optional adhesive layer 5, an optional charge transport layer 9 situated on optional charge blocking layer 7, a softenable layer 10 situated on optional charge transport layer 9, said softenable layer 10 comprising softenable material 11, charge transport material 16, and migration marking material 12 situated at or near the surface of the layer spaced from the substrate, and an infrared or red light radiation sensitive layer 13 situated on softenable layer 10 comprising infrared or red light radiation sensitive pigment particles 14 optionally dispersed in polymeric binder 15. Alternatively (not shown), infrared or red light radiation sensitive layer 13 can comprise infrared or red light radiation sensitive pigment particles 14 directly deposited as a layer by, for example, vacuum evaporation techniques or other coating methods. Optional overcoating layer 17 is situated on the surface of imaging member 1 spaced from the substrate 3.

Figure 2:
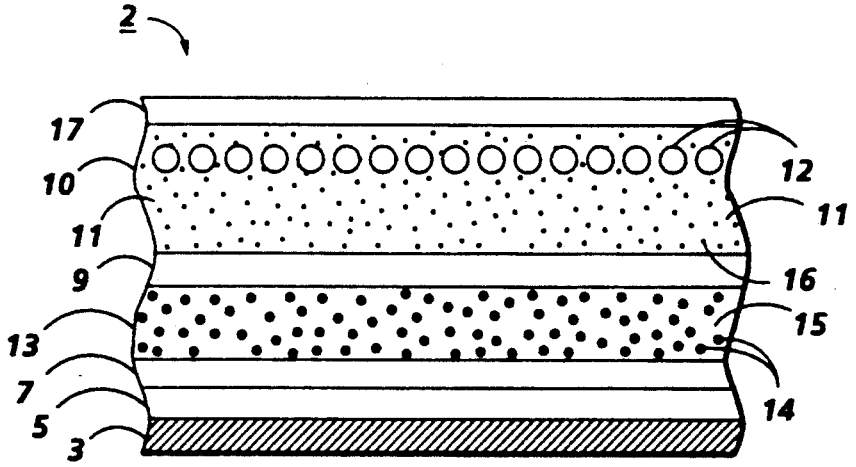

As illustrated schematically in FIG. 2, migration imaging member 2 comprises in the order shown a substrate 3, an optional adhesive layer 5 situated on substrate 3, an optional charge blocking layer 7 situated on optional adhesive layer 5, an infrared or red light radiation sensitive layer 13 situated on optional charge blocking layer 7 comprising infrared or red light radiation sensitive pigment particles 14 optionally dispersed in polymeric binder 15, an optional charge transport layer 9 situated on infrared or red light radiation sensitive layer 13, and a softenable layer 10 situated on optional charge transport layer 9, said softenable layer 10 comprising softenable material 11, charge transport material 16, and migration marking material 12 situated at or near the surface of the layer spaced from the substrate. Optional overcoating layer 17 is situated on the surface of imaging member 1 spaced from the substrate 3.

Any or all of the optional layers shown in FIGS. 1 and 2 can be absent from the imaging member. In addition, the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar ® (available from Du Pont) or Melinex ® 442, (available from ICI Americas, Inc.), and the like. In addition, the substrate can comprise an insulative layer with a conductive coating, such as vacuum-deposited metallized plastic, such as titanized or aluminized Mylar ® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside of this range.

The softenable layer can comprise one or more layers of softenable materials, which can be any suitable material, typically a plastic or thermoplastic material which is either heat softenable or soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 micron to about 30 microns, and preferably from about 2 microns to about 25 microns, although the thickness can be outside of this range. The softenable layer can be applied to the substrate by any suitable coating process. Typical coating processes include draw bar coating, spray coating, extrusion, dip coating, gravure roll coating, wire-wound rod coating, air knife coating and the like.

The softenable layer also contains migration marking material. The migration marking material is electrically photosensitive or photoconductive and sensitive to radiation at a wavelength other than that to which the infrared or red light sensitive pigment is sensitive. While the migration marking material may exhibit some photosensitivity in the wavelength to which the infrared or red light sensitive pigment is sensitive, it is preferred that photosensitivity in this wavelength range be minimized so that the migration marking material and the infrared or red light sensitive pigment exhibit absorption peaks in distinct, different wavelength regions. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the substrate. When present as particles, the particles of migration marking material preferably have an average diameter of up to 2 microns, and more preferably of from about 0.1 micron to about 1 micron. The layer of migration marking particles is situated at or near that surface of the softenable layer spaced from or most distant from the substrate. Preferably, the particles are situated at a distance of from about 0.01 micron from the layer surface, and more preferably from about 0.02 micron to 0.08 micron from the layer surface. Preferably, the particles are situated at a distance of from about 0.005 micron to about 0.2 micron from each other, and more preferably at a distance of from about 0.05 micron to about 0.1 micron from each other, the distance being measured between the closest edges of the particles, i.e. from outer diameter to outer diameter. The migration marking material contiguous to the outer surface of the softenable layer is present in any effective amount, preferably from about 2 percent to about 25 percent by total weight of the softenable layer, and more preferably from about 5 to about 20 percent by total weight of the softenable layer.

Examples of suitable migration marking materials include selenium, alloys of selenium with alloying components such as tellurium, arsenic, mixtures thereof, and the like, and any other suitable materials as disclosed, for example, in U.S. Pat. No. 3,975,195 and other U.S. patents directed to migration imaging members and incorporated herein by reference.

The migration marking particles can be included in the imaging members by any suitable technique. For example, a layer of migration marking particles can be placed at or just below the surface of the softenable layer by solution coating the substrate with the softenable layer material, followed by heating the softenable material in a vacuum chamber to soften it, while at the same time thermally evaporating the migration marking material onto the softenable material in the vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating process include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside this range. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside this range.

The migration imaging members contain a charge transport material in the softenable layer and may also contain a charge transport material in an optional separate charge transport layer. The charge transport material can be any suitable charge transport material. The charge transport material can be either a hole transport material (transports positive charges) or an electron transport material (transports negative charges). The sign of the charge used to sensitize the migration imaging member during preparation of the master can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897and 4,081,274, the disclosures of each of which are totally incorporated herein by reference. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260 and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. Nos. 4,150,987, 4,385,106, 4,338,388, and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. Nos. 4,256,821 and 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having for formula

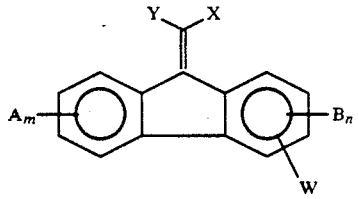

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)-malononitrile, (4-phenethoxycarbonyl-9-fluorenylidene)malononitrile, (4-carbitoxy-9-fluorenylidene)malononitrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substituted polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

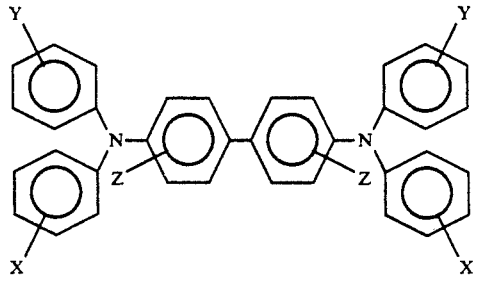

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Excellent results can be obtained when the softenable layer contains from about 8 percent to about 40 percent by weight of these diamine compounds based on the total weight of the softenable layer. Optimum results are achieved when the softenable layer contains from about 16 percent to about 32 percent by weight of N,N'-diphenyl-N,N'-bis(3''-methylphenyl)-(1,1'-biphenyl)-4,4'-diamine based on the total weight of the softenable layer.

The charge transport material can be present in the softenable material in any effective amount, generally from about 5 to about 50 percent by weight and preferably from about 8 to about 40 percent by weight. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the xeroprinting master making and xeroprinting steps of the present invention. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a substrate. Alternatively, a uniform deposit of electrostatic charge of suitable polarity on the exposed surface of the charge transport spacing layer can be substituted for a conductive substrate layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside of this range.

Charge transport molecules suitable for the charge transport layer are described in detail herein. The specific charge transport molecule utilized in the charge transport layer of any given imaging member can be identical to or different from any optional charge transport molecule employed in the softenable layer. Similarly, the concentration of the charge transport molecule utilized in the charge transport spacing layer of any given imaging member can be identical to or different from the concentration of any optional charge transport molecule employed in the softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside of this range. The charge transport material can be incorporated into the charge transport layer by similar techniques to those employed for the softenable layer.

The optional adhesive layer can include any suitable adhesive material. Typical adhesive materials include copolymers of styrene and an acrylate, polyester resin such as DuPont 49000 (available from E. I. duPont & de Nemours Company), copolymer of acrylonitrile and vinylidene chloride, polyvinyl acetate, polyvinyl butyral and the like and mixtures thereof. The adhesive layer can have any effective thickness, typically from about 0.05 micron to about 1 micron, although the thickness can be outside of this range. When an adhesive layer is employed, it preferably forms a uniform and continuous layer having a thickness of about 0.5 micron or less to ensure satisfactory discharge during the xeroprinting process. It can also optionally include charge transport molecules.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron, although the thickness can be outside of this range. Typical coating processes include draw bar coating, spray coating, extrusion, dip coating, gravure roll coating, wire-wound rod coating, air knife coating and the like.

The optional overcoating layer can be substantially electrically insulating, or have any other suitable properties. The overcoating preferably is substantially transparent, at least in the spectral region where electromagnetic radiation is used for imagewise exposure step in the master making process and for the uniform exposure step in the xeroprinting process. The overcoating layer is continuous and preferably of a thickness of up to about 1 to 2 microns. More preferably, the overcoating has a thickness of from about 0.1 micron to about 0.5 micron to minimize residual charge buildup. Overcoating layers greater than about 1 to 2 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling, master making, and xeroprinting. The overcoating layer preferably adheres strongly to the softenable layer to minimize damage. The overcoating layer can also have adhesive properties at its outer surface which provide improved resistance to toner filming during toning, transfer, and/or cleaning. The adhesive properties can be inherent in the overcoating layer or can be imparted to the overcoating layer by incorporation of another layer or component of adhesive material. These adhesive materials should not degrade the film forming components of the overcoating and preferably have a surface energy of less than about 20 ergs/cm$^2$. Typical adhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, after the members have been imaged, and during xeroprinting if it is used as a xeroprinting master.

If an optional overcoating layer is used on top of the softenable layer to improve abrasion resistance and if solvent softening is employed to effect migration of the migration marking material through the softenable material, the overcoating layer should be permeable to the vapor of the solvent used and additional vapor treatment time should be allowed so that the solvent vapor can soften the softenable layer sufficiently to allow the light-exposed migration marking material to migrate towards the substrate in image configuration. Solvent permeability is unnecessary for an overcoating layer if heat is employed to soften the softenable layer sufficiently to allow the exposed migration marking material to migrate towards the substrate in image configuration.

Further information concerning the structure, materials, and preparation of migration imaging members is disclosed in U.S. Pat. Nos. 3,975,195, 3,909,262, 4,536,457, 4,536,458, 4,013,462, 4,883,731, 4,123,283, 4,853,307, 4,880,715, U.S. application Ser. No. 590,959 (abandoned, filed Oct. 31, 1966, U.S. application Ser. No. 695,214 (abandoned, filed Jan. 2, 1968, U.S. application Ser. No. 000,172 (abandoned, filed Jan. 2, 1970, and P. S. Vincett, G. J. Kovacs, M. C. Tam, A. L. Pundsack, and P. H. Soden, *Migration Imaging Mechanisms, Exploitation, and Future Prospects of Unique Photographic Technologies, XDM and AMEN*, Journal of Imaging Science 30 (4) July/August; pp. 183-191 (1986), the disclosures of each of which are totally incorporated herein by reference.

The infrared or red light radiation sensitive migration imaging member of the present invention is imaged and developed to provide an imagewise pattern on the member. The imaged member can be used as an information recording and storage medium, for viewing and as a duplicating film, or, if desired, as a xeroprinting master in a xeroprinting process. Generally, it is expected that an imaged and developed migration imaging member of the present invention will have a relatively high background optical density as a result of the presence of the infrared or red light sensitive layer. For use as a xeromaster, this high background optical density is of no importance, since only the contrast voltage for the electrostatic latent image (i.e., the difference in potential between image and nonimage areas on the master during the xeroprinting process) affects the quality of the print generated from the master. When the imaged member is used for simple viewing or duplicating, the adverse effect of the relatively high background optical density can be minimized by selecting an infrared or red light sensitive pigment having an optical window for viewing and duplicating, for example in the green light wavelength region. An optical window of a pigment or material is a frequency band or frequency region of the visible electromagnetic spectrum where the pigment or material has a very low optical absorption. Hence, light is readily transmitted through this frequency window. When the infrared or red light sensitive pigment has a window in the green region, green light will be transmitted through this layer. Many phthalocyanine pigments, such as X-metal free phthalocyanine, exhibit this characteristic. For example, the X-form of metal free phthalocyanine transmits over 95 percent of the light in the green light wavelength region (about 490 namometers). Ideally, the infrared or red light sensitive pigment window coincides with the maximum optical contrast region of unmigrated migration marking material versus migrated migration marking material. When the migration image produced in the softenable layer has a high optical contrast density in the green region (i.e., high $D_{max}$ and low $D_{min}$), this high optical contrast density with low $D_{min}$ will be maintained when viewed through the optical window where the infrared or red light absorbing layer are highly transmitting.

Figure 3B:
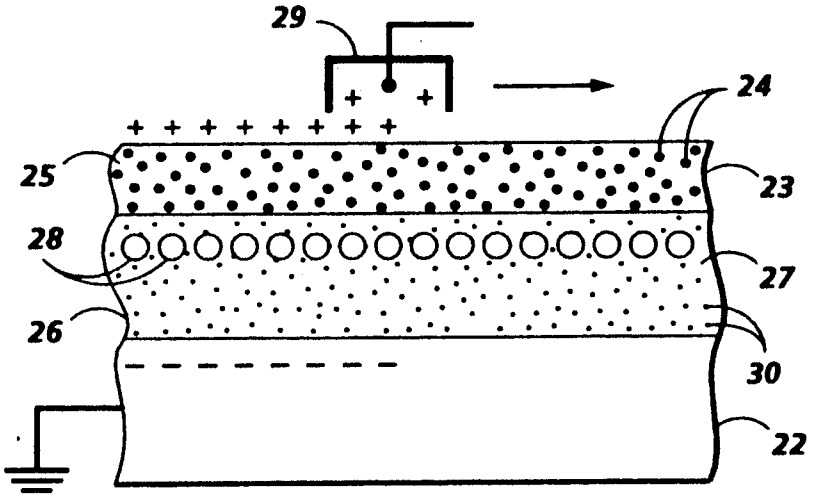
FIGS. 3A, 3B, 4A, 4B, 5A, 5B, 6A, 6B, 7A, 7B, 7C, 8A and 8B illustrate schematically processes for imaging and developing a migration imaging member of the present invention by imagewise exposure to infrared or red light.
Figure 3A:
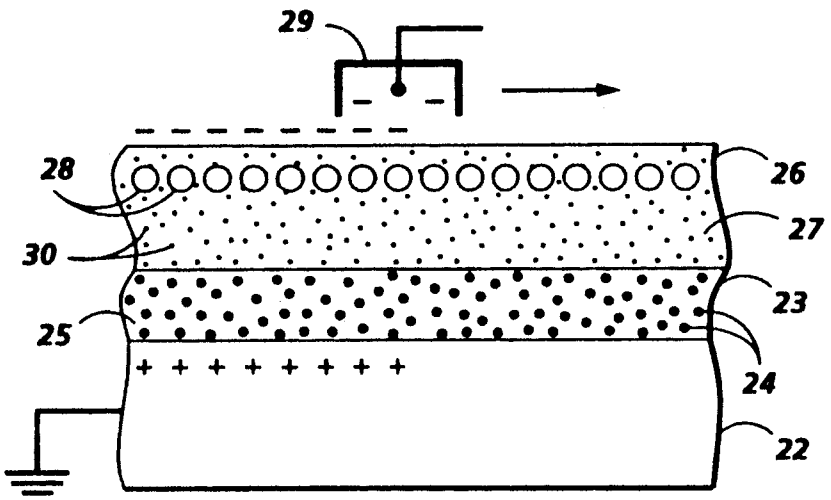

The process for imaging by imagewise exposure to infrared or red radiation and developing a migration imaging member of the present invention is illustrated schematically in FIGS. 3A and 3B through 8A and 8B. The imaged member can be used as an information recording and storage medium, for viewing and as a duplicating film. The imaged and developed imaging member can also be used as a master in a xeroprinting process as illustrated schematically in FIGS. 9A and 9B through 12A and 12B. The process illustrated schematically in FIGS. 3B, 4B, 5B, 5C, 6B, 7B, 7C, 8B, 9B, 10B, 11B, and 12B represents a particularly preferred embodiment of the present invention wherein the softenable layer is situated between the infrared or red light sensitive layer and the substrate and the softenable layer contains a charge transport material capable of transporting charges of one polarity. In the process steps illustrated in FIGS. 3B, 4B, 5B, 6B, and 7B, the imaging member is charged to the same polarity as that which the charge transport material in the softenable layer is capable of transporting; in the process steps illustrated schematically in FIGS. 5C and 7C, the imaging member is recharged to the polarity opposite to that which the charge transport material is capable of transporting. In FIGS. 3B, 4B, 5B, 5C, 6B, 7B, 7C, 8B, 9B, 10B, 11B, and 12B, the softenable material contains a hole transport material (capable of transporting positive charges). FIGS. 3A and 3B through 12A and 12B illustrate schematically a migration imaging member comprising a conductive substrate layer 22 that is connected to a reference potential such as a ground, an infrared or red light sensitive layer 23 comprising infrared or red light sensitive pigment particles 24 dispersed in polymeric binder 25, and a softenable layer 26 comprising softenable material 27, migration marking material 28, and charge transport material 30. As illustrated in FIGS. 3A and B, the member is uniformly charged in the dark to either polarity (negative charging is illustrated in FIG. 3A, positive charging is illustrated in FIG. 3B) by a charging means 29 such as a corona charging apparatus.

Figure 4B:
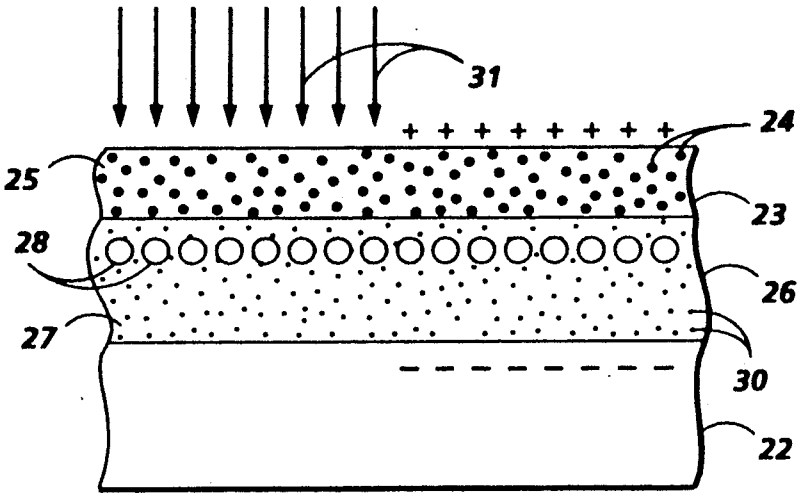
Figure 4A:
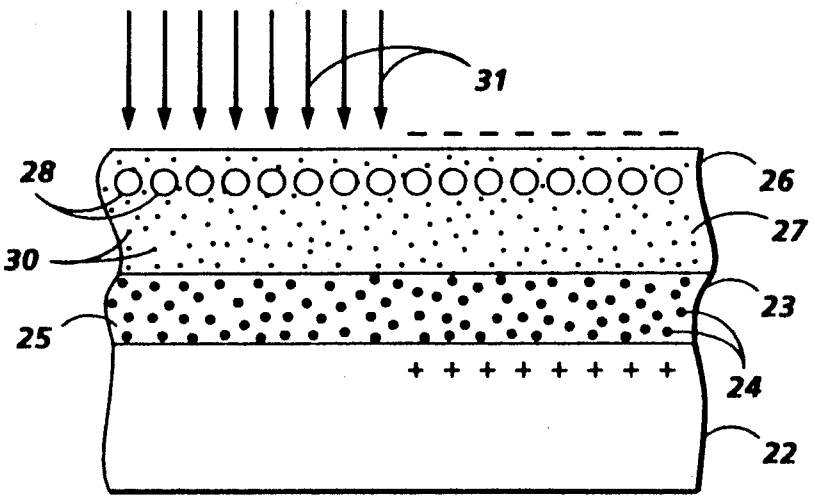

As illustrated schematically in FIGS. 4A and 4B, the charged member is first exposed imagewise to infrared or red light radiation 31. The wavelength of the infrared or red light radiation used is preferably selected to be in the region where the pigments exhibit maximum optical absorption and maximum photosensitivity. When the softenable layer 26 is situated between the infrared or red light sensitive layer 23 and the radiation source 31, as shown in FIG. 4A, the infrared or red light radiation 31 passes through the non-absorbing migration marking material 28 (which is selected to be substantially insensitive to the infrared or red light radiation wavelength used in this step) and exposes the infrared or red light sensitive pigment particles 24 in the infrared or red light sensitive layer. Absorption of infrared or red light radiation by the infrared or red light sensitive pigment results in substantial photodischarge in the exposed areas. The presence of a charge transporting material (a hole transport material in this instance) in the softenable layer ensures that the photogenerated charge (positive in this instance) can be efficiently transported to the surface to substantially neutralized the negative surface charge. Thus the areas that are exposed to infrared radiation become substantially discharged. As shown in FIG. 4B, when the infrared or red light sensitive layer 23 is situated between the softenable layer 26 and the radiation source 31 and the member is charged to the same polarity as the charge transport material in the softenable layer is capable of transporting, absorption of infrared or red light radiation by the infrared or red light sensitive pigment results in substantial photodischarge in the exposed areas. The presence of the charge transporting material (a hole transport material in this instance) in the softenable layer ensures that the photogenerated charge (positive in this instance) can be efficiently transported to the conductive substrate. Thus the areas that are exposed to infrared radiation become substantially discharged.

Figure 5B:
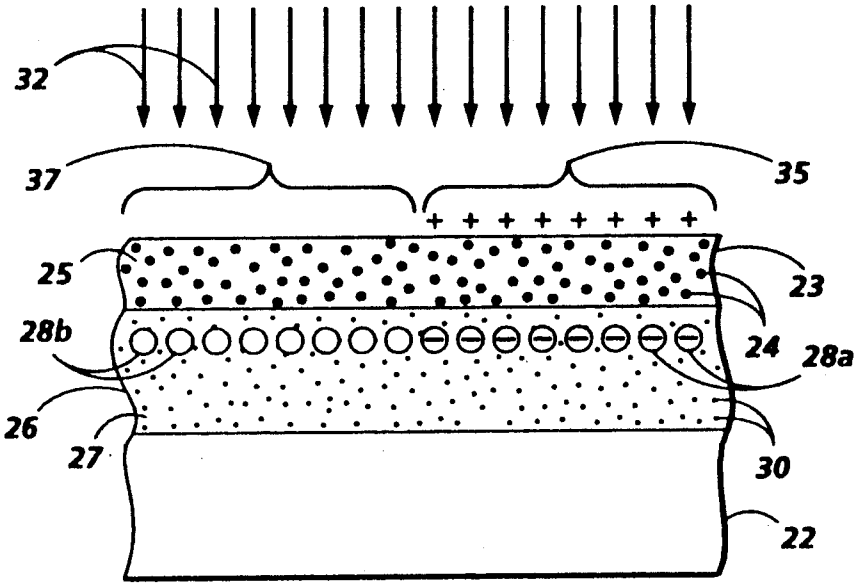
Figure 5A:
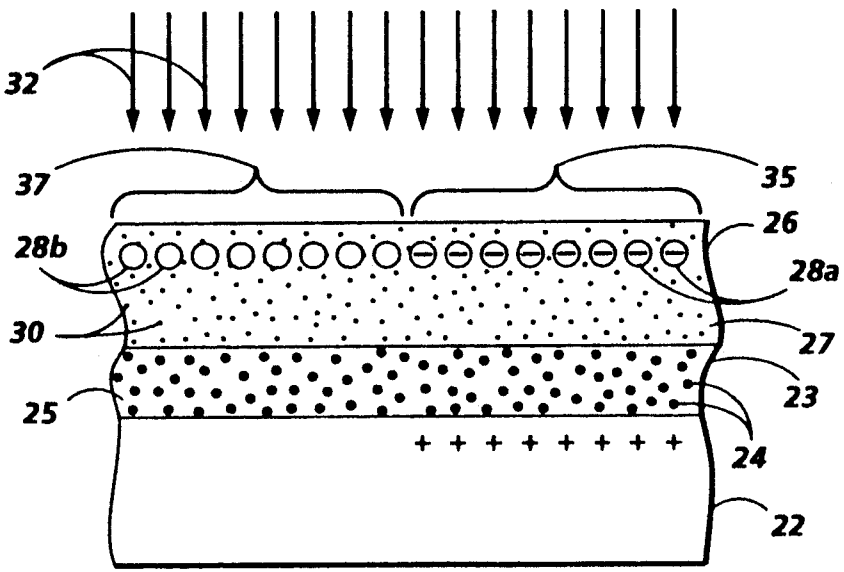

As illustrated schematically in FIGS. 5A and B, the charged member is subsequently exposed uniformly to activating radiation 32 at a wavelength to which the migration marking material 28 is sensitive. For example, when the migration marking material is selenium particles, blue or green light can be used for uniform exposure. As shown in FIG. 5A, when layer 26 is situated above layer 23, the uniform exposure to radiation 32 results in absorption of radiation by the migration marking material 28. (In the context of the present invention, "above" with respect to the ordering of the layers within the migration imaging member indicates that the layer is relatively nearer to the radiation source and relatively more distant from the substrate, and "below" with respect to the ordering of the layers within the migration imaging member indicates that the layer is relatively more distant from the radiation source and relatively nearer to the substrate.) In charged areas of the imaging member 35, the migration marking particles **28*a* acquire a negative charge as ejected holes (positive charges) discharge the surface charges, resulting in an electric field between the migration marking particles and the substrate. Areas 37 of the imaging member that have been substantially discharged by prior infrared or red light exposure are no longer sensitive, and the migration marking particles 28*b* in these areas acquire no or very little charge. As shown in FIG. 5B, when the infrared or red light sensitive layer 23 is situated above the softenable layer 26 and the member is charged to the same polarity as the charge transport material in the softenable layer is capable of transporting, uniform exposure to radiation 32 at a wavelength to which the migration marking material 28 is sensitive is largely absorbed by the migration marking material 28. The wavelength of the uniform light radiation is preferably selected to be in the region where the pigments in layer 23 exhibit maximum light transmission and where the migration marking particle 28 exhibit maximum light absorption. Thus, in areas of the imaging member which are still charged, the migration marking particles 28*a* acquire a negative charge as ejected holes (positive charges) transport through the softenable layer to the substrate. Areas 37 of the imaging member that have been substantially discharged by prior infrared or red light exposure are no longer light sensitive, and the migration marking particles 28*b*** in these areas acquire no or very little charge.

Figure 5C:
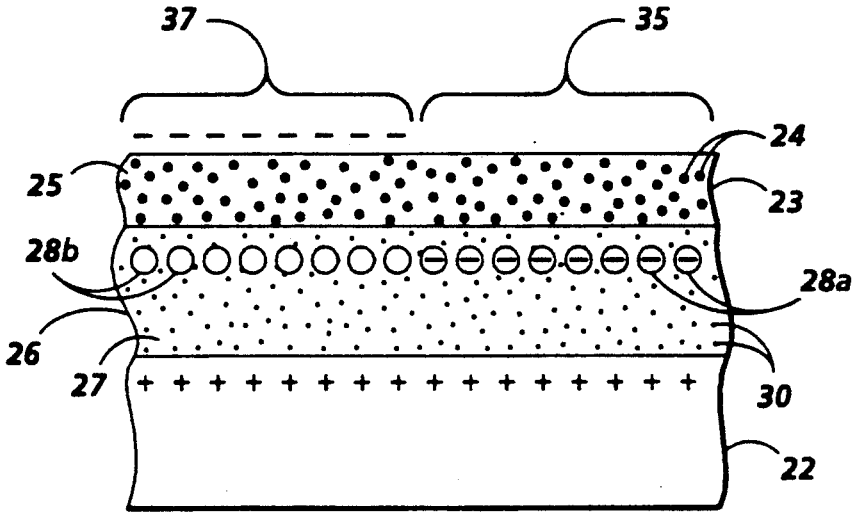

In the embodiment illustrated in FIG. 5B, the resulting charge pattern is such that the imaging member cannot be developed by heat development, since there is no substantial electric field between the migration marking materials and the substrate. The imaging member with a charge pattern as illustrated in FIG. 5B can be developed by a development process, such as solvent vapor exposure followed by heating, in which the non-charged particles agglomerate and coalesce into a few large particles, resulting in a $D_{min}$ region, and the non-charged particles, which repel each other because they bear like charges, are not agglomerated or coalesced and remain substantially in their original positions, resulting in a $D_{max}$ region, as disclosed in, for example, U.S. Pat. No. 4,880,715, the disclosure of which is totally incorporated herein by reference. Satisfactory results can be achieved with a vapor exposure time of between about 10 seconds and about 2 minutes at about 21° C., followed by heating to a temperature between about 80° C. and about 120° C. for from about 2 seconds to about 2 minutes and with solvent vapor partial pressures of between about 20 millimeters of mercury and about 80 millimeters of mercury when the solvent is methyl ethyl ketone and the softenable layer contains an 80/20 mole percent copolymer of styrene and hexylmethacrylate having an intrinsic viscosity of 0.179 deciliters per gram and N,N'-diphenyl-N,N'-bis(3''-methylphenyl)-(1,1'-biphenyl)-4,4'-diamine. However, heat development generally is preferred to vapor or solvent development for reasons of safety, speed, cost, simplicity, and easy implementation in a machine environment, particularly when the member is to be used as a xeroprinting master in a xeroprinting process. As shown in FIG. 5C, the imaging member is further subjected to uniform recharging to a polarity opposite to that which the charge transport material in the softenable layer is capable of transporting (negative as illustrated in FIG. 5C), resulting in the migration marking material in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member.

It is important to emphasize that in general, the step of imagewise exposing the member to infrared or red light radiation and the step of uniformly exposing the member to radiation at a wavelength to which the migration marking material is sensitive can take place in any order. When the member is first imagewise exposed to infrared or red light radiation as illustrated in FIGS. 4A and 4B and subsequently uniformly exposed to radiation to which the migration marking material is sensitive as illustrated in FIGS. 5A, 5B, and 5C, the process proceeds as described with respect to FIGS. 4A, 4B, 5A, 5B, and 5C. When the member is first uniformly exposed to radiation to which the migration marking material is sensitive and subsequently imagewise exposed to infrared or red light radiation, the process proceeds as described with respect to FIGS. 6A, 6B, 7A, 7B, and 7C.

Figure 6B:
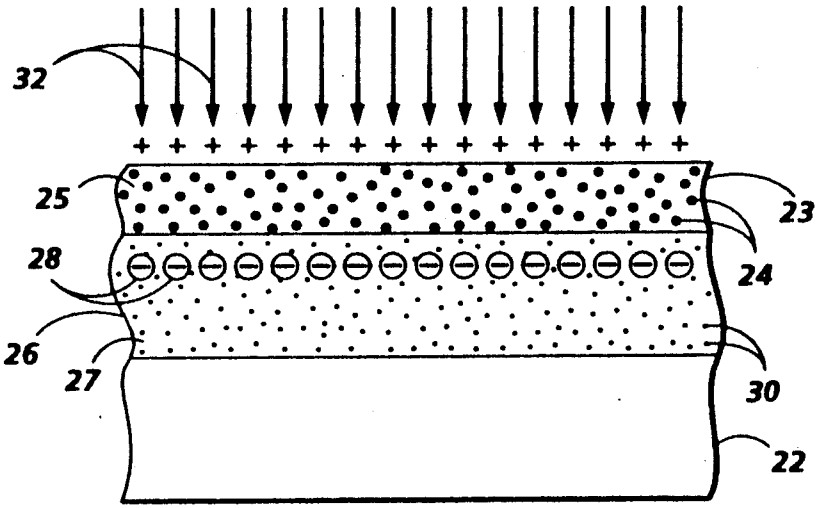
Figure 6A:
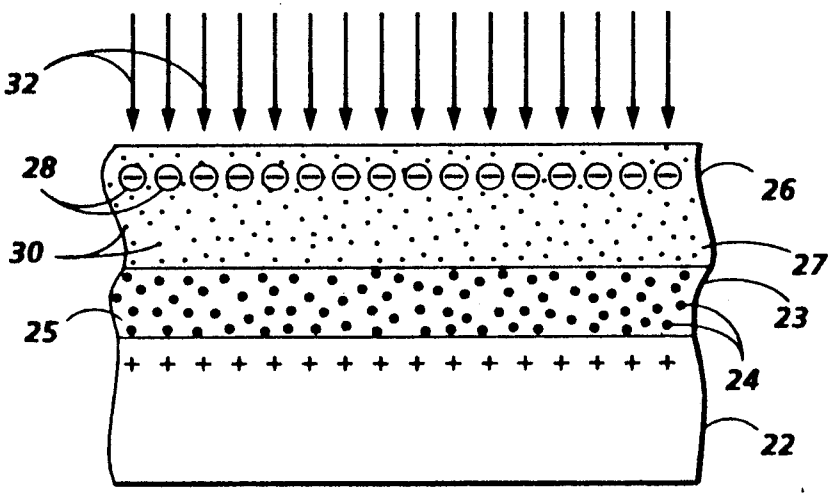

As illustrated schematically in FIGS. 6A and 6B, the charged member illustrated schematically in FIGS. 3A and 3B is first exposed uniformly to activating radiation 32 at a wavelength to which the migration marking material 28 is sensitive. For example, when the migration marking material is selenium particles, blue or green light can be used for uniform exposure. As shown in FIG. 6A, when layer 26 is situated above layer 23, the uniform exposure to radiation 32 results in absorption of radiation by the migration marking material 28. The migration marking particles 28 acquire a negative charge as ejected holes (positive charges) discharge the surface negative charges. As shown in FIG. 6B, when layer 23 is situated above layer 26, uniform exposure to activation radiation 32 at a wavelength to which the migration marking material is sensitive results in substantial photodischarge as the photogenerated charges (holes in this instance) in the migration marking particles are ejected out of the particles and transported to the substrate. As a result, the migration marking particles acquire a negative charge as shown schematically in FIG. 6B.

Figure 7B:
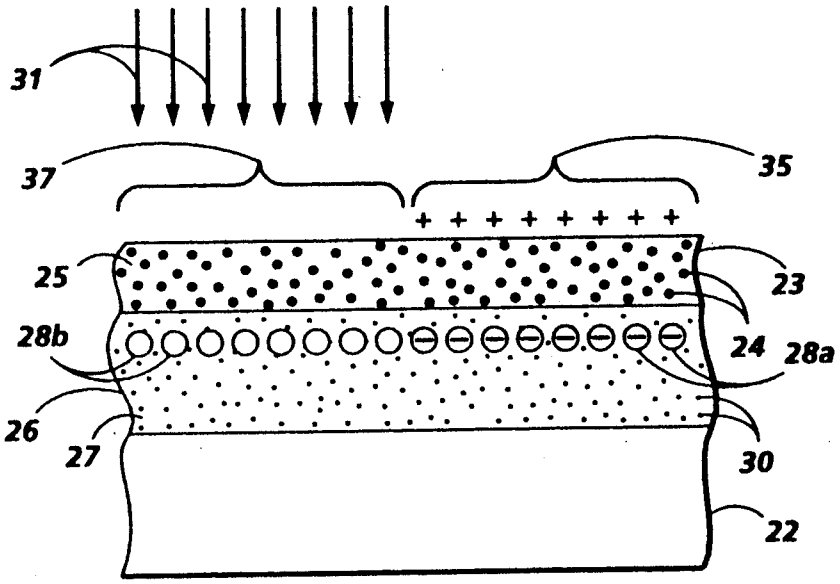
Figure 7A:
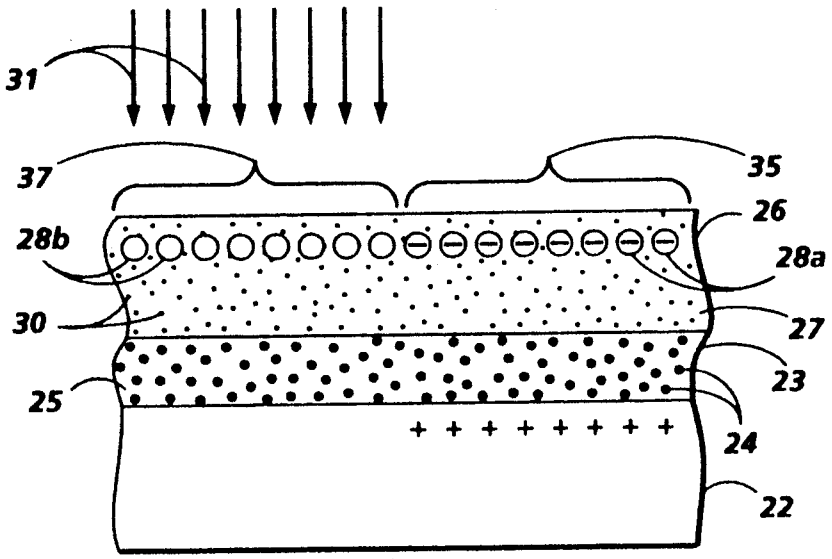
Figure 7C:
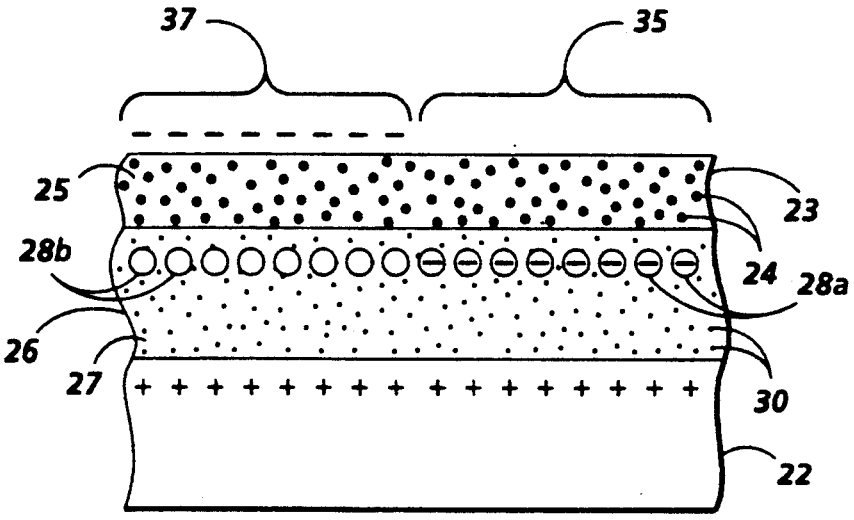

As illustrated schematically in FIGS. 7A, 7B, and 7C, the charged member is subsequently exposed imagewise to infrared or red light radiation 31. As shown in FIG. 7A, when the softenable layer 26 is situated between the infrared or red light sensitive layer 23 and the radiation source 31, the infrared or red light radiation 31 passes through the non-absorbing migration marking material 28 (which is selected to be insensitive to the infrared or red light radiation wavelength used in this step) and exposes the infrared or red light sensitive pigment particles 24 in the infrared or red light sensitive layer, thereby discharging the migration marking particles 28*b* in area 37 that are exposed to infrared or red light radiation and leaving the migration marking particles 28*a* charged in areas 35 not exposed to infrared or red light radiation. As shown in FIG. 7B, when layer 23 is situated above layer 26, and the charged member is subsequently imagewise exposed to infrared or red light radiation 31, absorption of the infrared or red light by layer 23 in the exposed areas results in photogeneration of electrons and holes which neutralize the positive surface charge and the negative charge in the migration marking particles.

In the embodiment illustrated in FIG. 7B, the resulting charge pattern is such that the imaging member cannot be developed by heat development, since there is no substantial electric field between the migration marking materials and the substrate. The imaging member with a charge pattern as illustrated in FIG. 7B can be developed by a development process, such as solvent vapor exposure followed by heating, in which the non-charged particles agglomerate and coalesce into a few large particles, resulting in a $D_{min}$ region, and the non-charged particles, which repel each other because they bear like charges, are not agglomerated or coalesced and remain substantially in their original positions, resulting in a $D_{max}$ region. However, heat development generally is preferred to vapor or solvent development for reasons of safety, speed, cost, simplicity, and easy implementation in a machine environment, particularly when the member is to be used as a xeroprinting master in a xeroprinting process. As shown schematically in FIG. 7C, the imaging member is further subjected to uniform recharging to a polarity opposite to that which the charge transport material in the softenable layer is capable of transporting (negative as illustrated in FIG. 7C), resulting in the migration marking material in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member. The charge image pattern obtained after the processes illustrated schematically in FIGS. 6A, and 6B and FIGS. 7A, 7B, and 7C is thus identical to the one obtained after the processes illustrated schematically in FIGS. 4A and 4B and FIGS. 5A, 5B, and 5C.

Figure 8B:
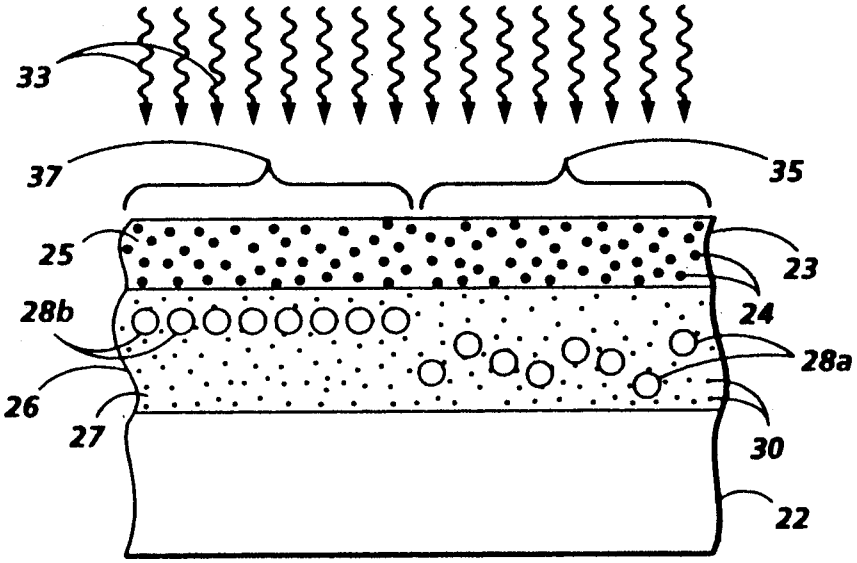
Figure 8A:
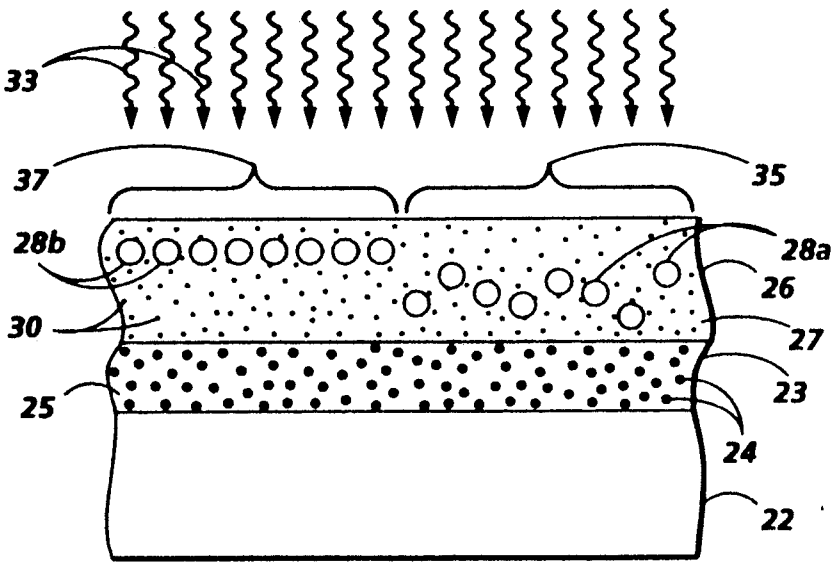

As illustrated schematically in FIGS. 8A and 8B, subsequent to formation of a charge image pattern, the imaging member is developed by causing the softenable material to soften by any suitable means (in FIGS. 8A and 8B, by uniform application of heat energy 33 to the member). The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only applied for a few seconds. For lower temperatures, more heating time can be required. When the heat is applied, the softenable material 27 decreases in viscosity, thereby decreasing its resistance to migration of the marking material 28 through the softenable layer 26. As shown in FIG. 8A, when layer 26 is situated above layer 23, in areas 35 of the imaging member, wherein the migration marking material 28*a* has a substantial net charge, upon softening of the softenable material 27, the net charge causes the charged marking material to migrate in image configuration towards the conductive layer 22 and disperse in the softenable layer 26, resulting in a $D_{min}$ area. The uncharged migration marking particles 28*b* in areas 37 of the imaging member remain essentially neutral and the absence of migration force, the unexposed migration remain substantially in their original position in softenable resulting in a $D_{max}$ area. As shown in FIG. 8B, in the wherein layer 23 is situated above layer 26 and the member was step 3B to the same polarity as that which the charge the softenable layer is capable of transporting and in which has been recharged as shown in FIG. 5C or 7C to the polarity that which the charge transport material in the softenable of transporting, the migration marking particles that are not exposed to infrared or red light radiation) migrate in substrate 22 and disperse in softenable layer 26, resulting in area. The uncharged migration marking particles 28b in areas 37 of member remain essentially neutral and uncharged. Thus, in the migration force, the unexposed migration marking particles substantially in their original positions in softenable layer $D_{max}$ area.

If desired, solvent vapor development can be substituted heat development. Vapor development of migration imaging well known in the art. Generally, if solvent vapor softening solvent vapor exposure time depends upon factors such as the the softenable layer in the solvent, the type of solvent temperature, the concentration of the solvent vapors, and the The application of either heat, or solvent vapors, or combinations thereof, or any other suitable means should be decrease the resistance of the softenable material 27 of to allow migration of the migration marking material 28 softenable layer 26 in imagewise configuration. With heat development, satisfactory results can be achieved by heating the imaging member to a temperature of about 100° C. to about 130° C. for only a few seconds when the unovercoated softenable layer contains an 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine. The test for a satisfactory combination of time and temperature is to maximize optical contrast density and electrostatic contrast potential for xeroprinting. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layer contains an 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine.

The imaging member illustrated in FIGS. 3A and 3B through 12A and 12B is shown without any optional layers such as those illustrated in FIG. 1. If desired, alternative imaging member embodiments, such as those employing any or all of the optional layers illustrated in FIG. 1, can also be employed.

Figure 9B:
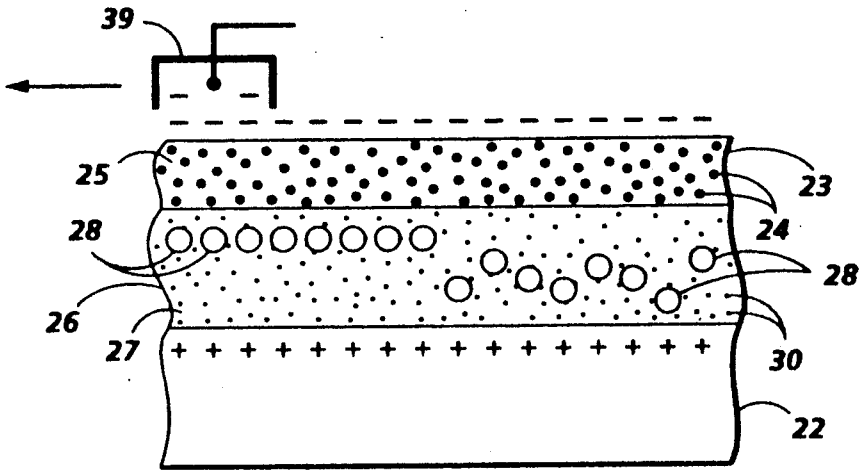
FIGS. 9A, 9B, 10A, 10B, 11A, 11B, 12A and 12B illustrate schematically a xeroprinting process according to the present invention, wherein an imaged and developed migration imaging member of the present invention is employed as a xeroprinting master.
Figure 9A:
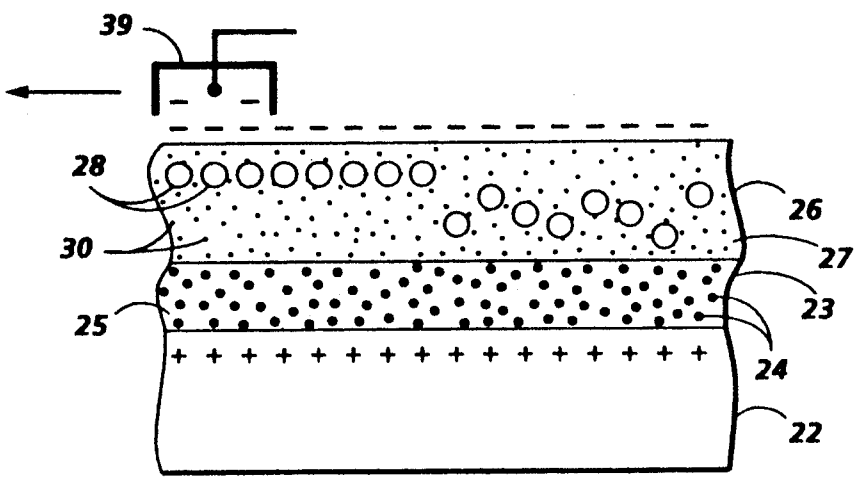

The developed imaging member as illustrated in FIGS. 8A and 8B can thereafter be used as a xeromaster in a xeroprinting process. The use of the xeroprinting master in a xeroprinting process is illustrated schematically in FIGS. 9A and 9B through 12A and 12B. As illustrated schematically in FIGS. 9A and 9B, the xeroprinting master is uniformly charged by a charging means 39 such as a corona charging device. Charging is to any effective magnitude; generally, positive or negative voltages of from about 50 to about 1,200 volts are suitable for the process of the present invention, although other values can be employed. In a preferred embodiment, when an optional charge transport material is present in the softenable layer or in an optional charge transport layer, the polarity of the charge applied depends on the nature of the charge transport material present in the master, and preferably is opposite in polarity to the type of charge which the charge transport material is capable of transporting; thus, when the charge transport material is capable of transporting holes (positive charges), the master is charged negatively, and when the charge transport material is capable of transporting electrons (negative charges), the master is charged positively. As illustrated in FIGS. 9A and 9B, the master is uniformly negatively charged.

Figure 10B:
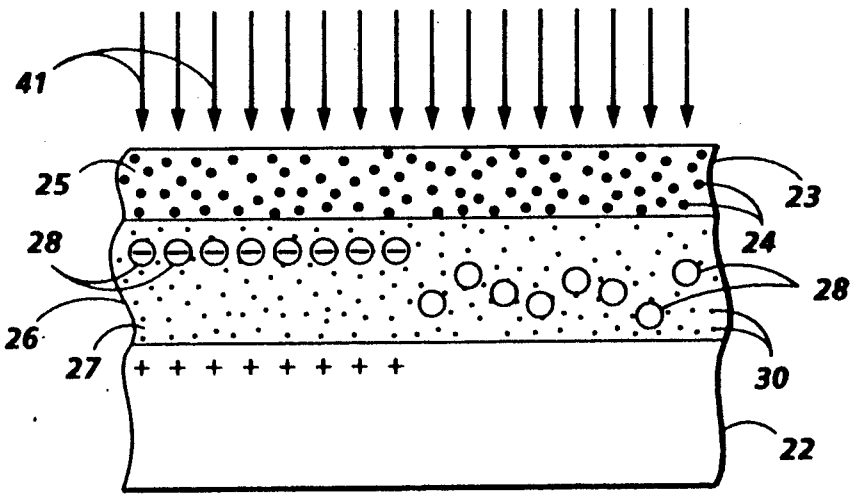
Figure 10A:
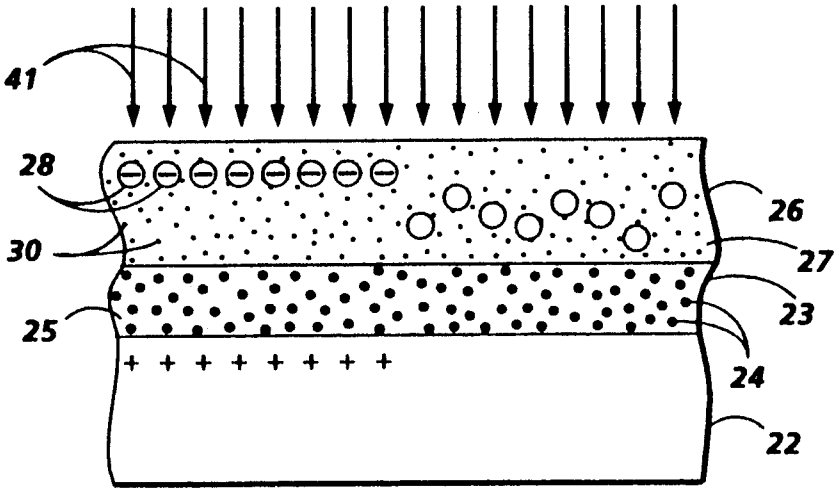

The charged xeroprinting master is then uniformly flash exposed to activating radiation 41, such as light energy at a wavelength to which the migration marking material is sensitive, as illustrated schematically in FIGS. 10A and 10B to form an electrostatic latent image. The activating electromagnetic radiation used for the uniform exposure step should be in the spectral region where the migration marking particles photogenerate charge carriers. Light in the spectral region of 300 to 800 nanometers is generally suitable for the process of the present invention, although the wavelength of the light employed for exposure can be outside of this range, and is selected according to the spectral response of the specific migration marking particles selected. The exposure energy should be such that the desired and/or optimal electrostatic contrast potential is obtained, and preferably is from about 10 ergs per square centimeter to about 100,000 ergs per square centimeter and more preferably at least 100 ergs per square centimeter. Because of the differences in the relative positions (or particle distribution) of the migration marking material in the $D_{max}$ and $D_{min}$ areas of the softenable layer 26, the $D_{max}$ and $D_{min}$ areas exhibit different photodischarge characteristics and optical absorption characteristics. The voltage difference between the $D_{min}$ (migrated) areas of the master and the $D_{max}$ (unmigrated) areas of the master is the contrast voltage available for xerographic development of the electrostatic latent image. Preferably, the contrast voltage is from about 50 to about 1200 volts, although this value can be outside of the specified range provided that the objectives of the present invention are achieved. With positive charging of the master (not shown), photodischarge occurs predominantly in the $D_{max}$ area because the charge transport material (holes) is capable of transporting efficiently the photogenerated positive charge carriers to the conductive substrate. Photodischarge also occurs in the $D_{min}$ areas of the master, but at a much slower rate, because the migration and dispersion of Se particles has degraded the photosensitivity in the $D_{min}$ areas. It is believed that particle to particle hopping transport causes photodischarge in the $D_{min}$ areas. The contrast voltage of the electrostatic image is the difference between the photodischarged voltage in the $D_{max}$ and $D_{min}$ areas. As the flood exposure energy increases, the contrast voltage initially increases, reaches a maximum, and then decreases.

In the situation wherein negative polarity is used for charging the master (as illustrated in FIGS. 9A and 9B through 12A and 12B), photodischarge occurs predominantly in the $D_{min}$ area, which in spite of its degraded photosensitivity can still be photodischarged almost completely if sufficient light intensity is employed for the flood exposure step. On the other hand, substantially less photodischarge occurs in the $D_{max}$ areas of the master. As shown in FIG. 10A, when the infrared or red light sensitive layer 23 is situated between the softenable layer 26 and the substrate 22, unifom light exposure in the spectral region where the migration marking particle is photosensitive causes photodischarge to occur predominantly in the $D_{min}$ areas of the master and substantially less photodischarge in the $D_{max}$ areas of the master. Although the photogenerated negative charges (electrons) injected from the migration marking particles cannot be transported to the conductive substrate because of the absence of electron transport material in the softenable layer, photogenerated positive charges (holes) from the infrared or red sensitive layer can be transported through the softenable layer to result in photodischarge if sufficient light can transmit through the migration marking material to reach the infrared or red sensitive layer. Since the migration marking material in the $D_{max}$ areas substantially absorbs the flood exposure light used, only a slight amount of light can reach the infrared or red sensitive layer, resulting in substantially less photodischarge in the $D_{max}$ areas of the master compared with the $D_{min}$ areas of the master. On the other hand, substantially more light can reach the infrared or red sensitive layer in the $D_{min}$ areas to cause substantially more photodischarge in the $D_{min}$ areas of the master. The contrast voltage of the electrostatic image is the difference between the photodischarged voltage in the $D_{max}$ and $D_{min}$ areas. As the flood exposure energy increases, the contrast voltage initially increases, reaches a maximum, and then decreases.

Additionally, in the particularly preferred embodiment shown in FIG. 10B, when the softenable layer 26 is situated between the infrared or red light sensitive layer 23 and the substrate 22, uniform light exposure causes little photodischarge in the $D_{max}$ areas of the master (even when very intense light is used) but almost complete photodischarge in the $D_{min}$ areas of the master if sufficiently intense light is used. This result occurs because in the $D_{max}$ areas, the photogenerated charge carriers (holes) cannot be transported to the conductive substrate when the master is charged to a polarity opposite to the polarity of the type of charge of which the charge transport material is capable of transporting. As a result, the photogenerated charge carriers become trapped in the unmigrated marking particles. The $D_{min}$ areas where the migration marking particles have migrated and dispersed in the softenable layer behave as a photoreceptor which exhibits low photosensitivity, but which can still be photodischarged almost completely if intense light is employed for flood exposure. Thus as the flood exposure energy increases, the contrast voltage initially increases rapidly and then saturates at a constant value. As a result, high contrast voltage is obtained. The contrast voltage is affected by the thickness of the softenable layer. For example, a xeroprinting master having a thickness of about 8 microns for the softenable layer 26 and a thickness of about 0.4 microns for the infrared and/or red sensitive layer and charged to an initial surface voltage of about 800 volts, generally can attain a contrast voltage of about 700 volts. It is believed that in the $D_{min}$ areas, particle to particle hopping transport allows full discharge if intense light is employed for flood exposure.

Figure 11B:
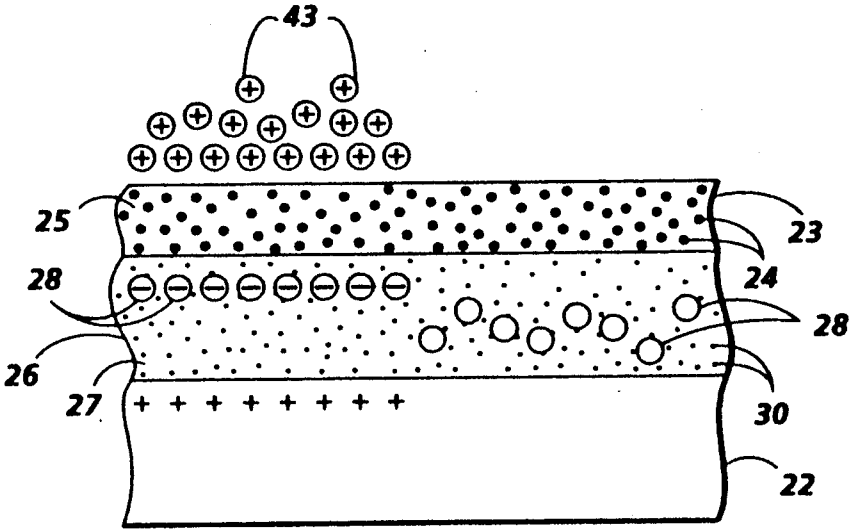
Figure 11A:
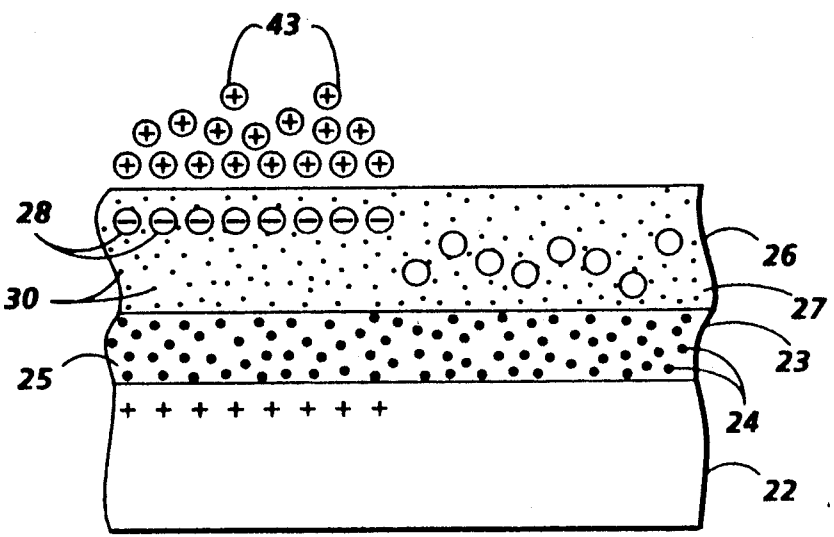

Subsequently, as illustrated in FIGS. 11A and 11B, the electrostatic latent image formed by flood exposing the charged master to light is then developed with toner particles 43 to form a toner image corresponding to the electrostatic latent image in the $D_{max}$ area. In FIGS. 11A and 11B, the toner particles 43 carry a positive electrostatic charge and are attracted to the oppositely charged portions in the $D_{max}$ area (unmigrated particles). However, if desired, the toner can be deposited in the discharged areas by employing toner particles having the same polarity as the charged areas (negative in the embodiment shown in FIGS. 11A and 11B). The toner particles 43 will then be repelled by the charges overlying the $D_{max}$ area and deposit in the discharged areas ($D_{min}$ area). Well known electrically biased development electrodes can also be employed, if desired, to direct toner particles to either the charged or discharged areas of the imaging surface.

The developing (toning) step is identical to that conventionally used in electrophotographic imaging. Any suitable conventional electrophotographic dry or liquid developer containing electrostatically attractable toner particles can be employed to develop the electrostatic latent image on the xeroprinting master. Typical dry toners have a particle size of between about 6 microns and about 20 microns. Typical liquid toners have a particle size of between about 0.1 micron and about 6 microns. The size of toner particles generally affects the resolution of prints. For applications demanding very high resolution, such as in color proofing and printing, liquid toners are generally preferred because their much smaller toner particle size gives better resolution of fine half-tone dots and produce four color images without undue thickness in densely toned areas. Conventional electrophotographic development techniques can be utilized to deposit the toner particles on the imaging surface of the xeroprinting master.

This invention is suitable for development with dry two-component developers. Two-component developers comprise toner particles and carrier particles. Typical toner particles can be of any composition suitable for development of electrostatic latent images, such as those comprising a resin and a colorant. Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they can be present in greater or lesser amounts, provided that the objectives of the invention are achieved.

Any suitable pigments or dyes or mixture thereof can be employed in the toner particles. Typical pigments or dyes include carbon black, nigrosine dye, aniline blue, magnetites, and mixtures thereof, with carbon black being a preferred colorant. The pigment is preferably present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles can be present provided that the objectives of the present invention are achieved.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the Color Index as Cl 60710, Cl Dispersed Red 15, a diazo dye identified in the Color Index as Cl 26050, Cl Solvent Red 19, and the like. Illustrative examples of suitable cyan pigments include copper tetra-4-(octadecyl sulfonamido) phthalocyanine, X-copper phthalocyanine pigment, listed in the color index as Cl 74160, Cl Pigment Blue, and Anthradanthrene Blue, identified in the Color Index as Cl 69810, Special Blue X-2137, and the like. Illustrative examples of yellow pigments that can be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. These color pigments are generally present in an amount of from about 15 weight percent to about 20.5 weight percent based on the weight of the toner resin particles, although lesser or greater amounts can be present provided that the objectives of the present invention are met.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight, although they can be present in greater or lesser amounts, provided that the objectives of the invention are achieved.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size between about 6 microns and about 20 microns.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a pigment, and an external additive can comprise 80 percent by weight resin and 20 percent by weight pigment; the amount of external additive present is reported in terms of its percent by weight of the combined resin and pigment. External additives can include any additives suitable for use in electrostatographic toners, including straight silica, colloidal silica (e.g. Aerosil R972®, available from Degussa, Inc.), ferric oxide, unilin, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any suitable amount, provided that the objectives of the present invention are achieved.

Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process. Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. The toner may be present, for example, in the two-component developer in an amount equal to about 1 to about 5 percent by weight of the carrier, and preferably is equal to about 3 percent by weight of the carrier.

Typical dry toners are disclosed, for example, in U.S. Pat. Nos. 2,788,288, 3,079,342, and U.S Pat. No. Re. 25,136, the disclosures of each of which are totally incorporated herein by reference.

If desired, development can be effected with liquid developers. Liquid developers are disclosed, for example, in U.S. Pat. Nos. 2,890,174 and 2,899,335, the disclosures of each of which are totally incorporated herein by reference. Liquid developers can comprise aqueous based or oil based inks, and include both inks containing a water or oil soluble dye substance and pigmented inks. Typical dye substances are Methylene Blue, commercially available from Eastman Kodak Company, Brilliant Yellow, commercially available from the Harlaco Chemical Company, potassium permanganate, ferric chloride and Methylene Violet, Rose Bengal and Quinoline Yellow, the latter three available from Allied Chemical Company, and the like. Typical pigments are carbon black, graphite, lamp black, bone black, charcoal, titanium dioxide, white lead, zinc oxide, zinc sulfide, iron oxide, chromium oxide, lead chromate, zinc chromate, cadmium yellow, cadmium red, red lead, antimony dioxide, magnesium silicate, calcium carbonate, calcium silicate, phthalocyanines, benzidines, naphthols, toluidines, and the like. The liquid developer composition can comprise a finely divided opaque powder, a high resistance liquid, and an ingredient to prevent agglomeration. Typical high resistance liquids include such organic dielectric liquids as paraffinic hydrocarbons such as the Isopar® and Norpar® family, carbon tetrachloride, kerosene, benzene, trichloroethylene, and the like. Other liquid developer components or additives include vinyl resins, such as carboxy vinyl polymers, polyvinylpyrrolidones, methylvinylether maleic anhydride interpolymers, polyvinyl alcohols, cellulosics such as sodium carboxy-ethylcellulose, hydroxypropylmethyl cellulose, hydroxyethyl cellulose, methyl cellulose, cellulose derivatives such as esters and ethers thereof, alkali soluble proteins, casein, gelatin, and acrylate salts such as ammonium polyacrylate, sodium polyacrylate, and the like.

Any suitable conventional electrophotographic development technique can be utilized to deposit toner particles on the electrostatic latent image on the imaging surface of the xeroprinting master. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. Nos. 2,618,551 and 2,618,552, the disclosures of each of which are totally incorporated herein by reference; powder cloud development is more fully described, for example, in U.S. Pat. Nos. 2,725,305, 2,918,910, and 3,015,305, the disclosures of each of which are totally incorporated herein by reference; and liquid development is more fully described, for example, in U.S. Pat. No. 3,084,043, the disclosure of which is totally incorporated herein by reference.

Figure 12A:
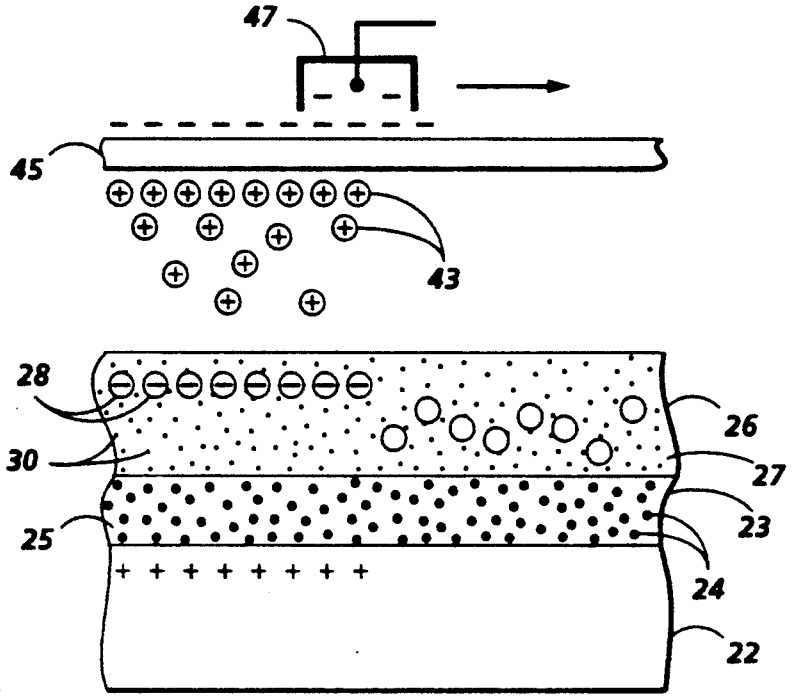
Figure 12B:
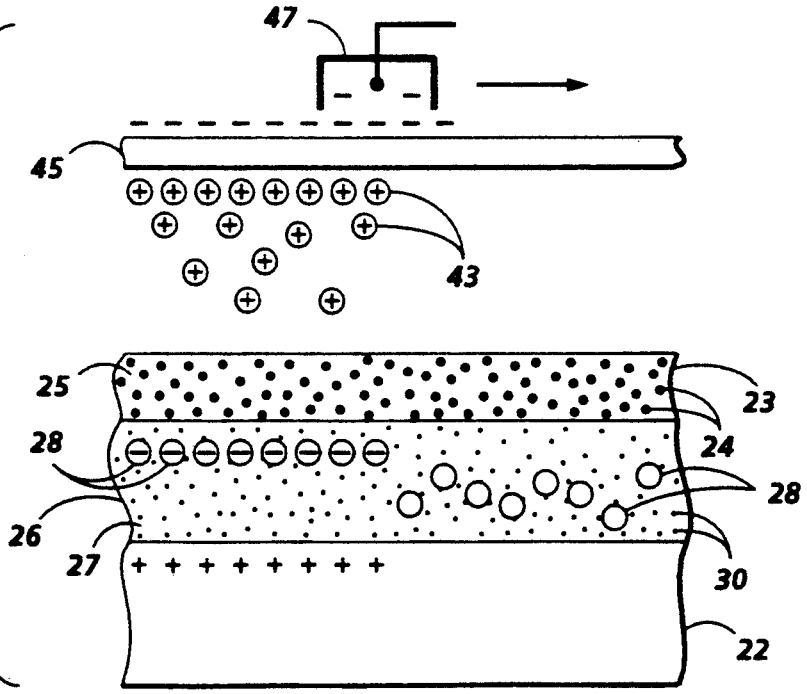

As illustrated schematically in FIGS. 12A and 12B, the deposited toner image is subsequently transferred to a receiving member 45, such as paper, by applying an electrostatic charge to the rear surface of the receiving member by means of a charging means 47 such as a corona device. The transferred toner image is thereafter fused to the receiving member by conventional means (not shown) such as an oven fuser, a hot roll fuser, a cold pressure fuser, or the like.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5,000 and about 8,000 volts provides satisfactory transfer.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

After the toned image is transferred, the xeroprinting master can be cleaned, if desired, to remove any residual toner and then erased by an AC corotron, or by any other suitable means. The developing, transfer, fusing, cleaning and erasure steps can be identical to that conventionally used in xerographic imaging. Since the xeroprinting master produces identical successive images in precisely the same areas, it has not been found necessary to erase the electrostatic latent image between successive images. However, if desired, the master can optionally be erased by conventional AC corona erasing techniques, which entail exposing the imaging surface to AC corona discharge to neutralize any residual charge on the master. Typical potentials applied to the corona wire of an AC corona erasing device range from about 3 kilovolts to about 10 kilovolts.

If desired, the imaging surface of the xeroprinting master can be cleaned. Any suitable cleaning step that is conventionally used in electrophotographic imaging can be employed for cleaning the xeroprinting master of this invention. Typical well known electrophotographic cleaning techniques include brush cleaning, blade cleaning, web cleaning, and the like.

After transfer of the deposited toner image from the master to a receiving member, the master can, with or without erase and cleaning steps, be cycled through additional uniform charging, uniform illumination, development and transfer steps to prepare additional imaged receiving members.

The process illustrated in FIGS. 3B, 4B, 5B, 5C, 6B, 7B, 7C, 8B, 9B, 10B, 11B, and 12B is particularly preferred for xeroprinting applications because the process is capable of generating images on the member by exposure to infrared or red light radiation with high sensitivity (for example, about 40 to about 60 ergs per square centimeter are required at about 780 nanometers) and the process yields high contrast voltage (often over 700 volts) and stable electrical cycling (with stability frequently continuing for over 1,000 imaging cycles).

Figure 13B:
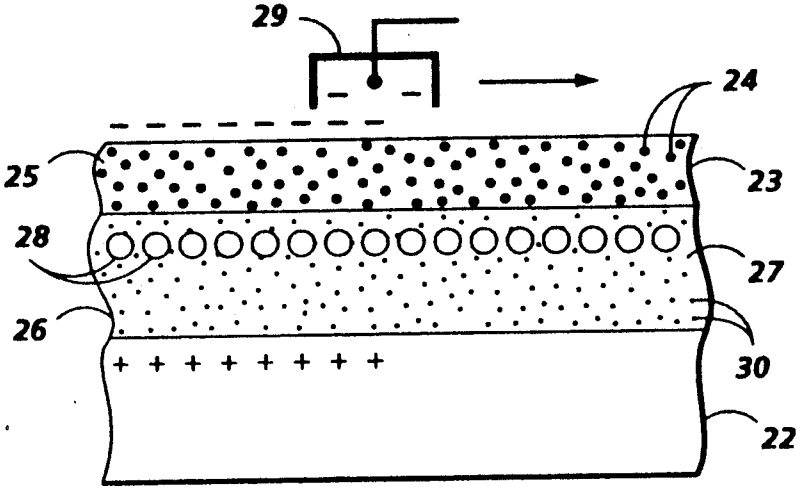
FIGS. 13A, 13B, 14A, 14B, 15A and 15B illustrate schematically processes for imaging and developing a migration imaging member of the present invention by imagewise exposure to blue/green light, indicating that the infrared or red light sensitive migration imaging members of the present invention are also sensitive to blue light and can also be imaged by exposure thereto.
Figure 13A:
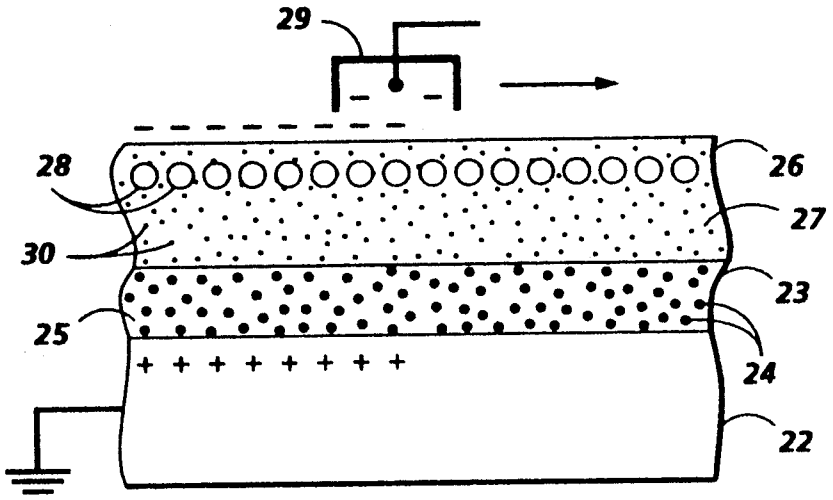
Figure 14B:
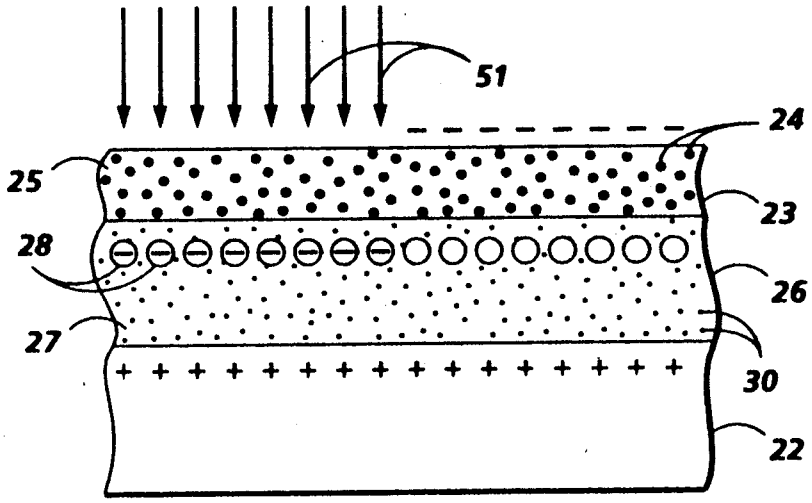
Figure 14A:
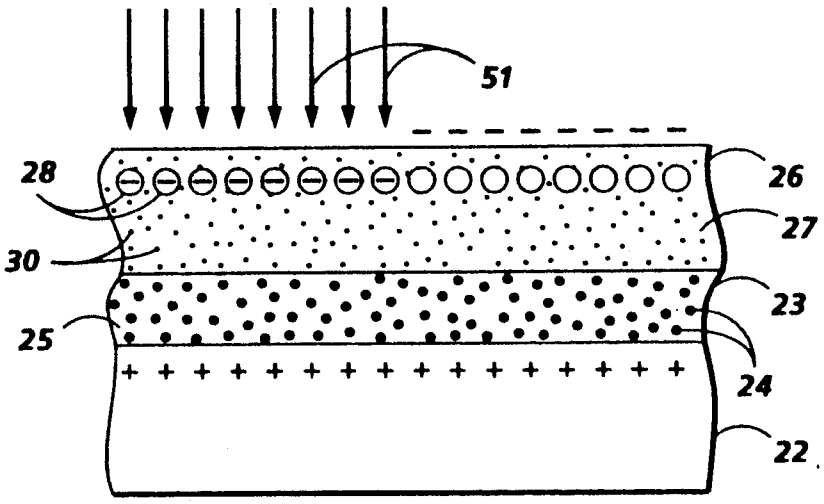
Figure 15B:
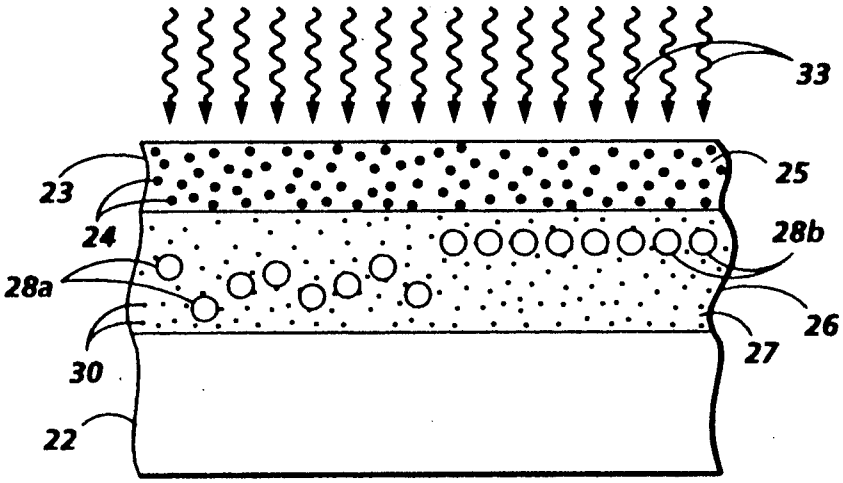
Figure 15A:
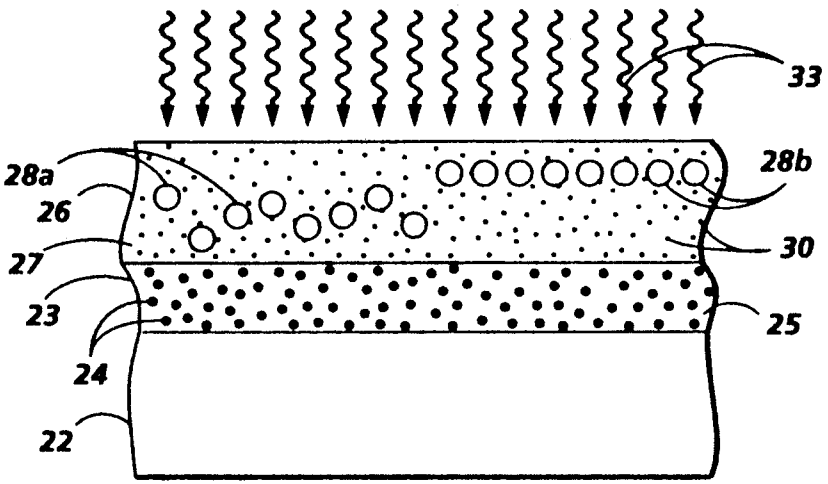

The imaging member as shown schematically in FIGS. 1 and 2 can also be imaged by imagewise exposure to radiation at a wavelength at which the migration marking material is most photosensitive. For example, if amorphous selenium, which is most sensitive in the blue/green spectral region, is used as migration marking material, the imaging member can be imaged by imagewise exposure to blue/green light. The imaging process in this case is illustrated schematically in FIGS. 13A and 13B through 15A and 15B. As illustrated in FIGS. 13A and 13B, the imaging member comprising a conductive substrate layer 22, an infrared or red light sensitive layer 23 comprising infrared or red light sensitive pigment particles 24 dispersed in polymeric binder 25, and a softenable layer 26 comprising softenable material 27, migration marking material 28, and charge transport material 30 is uniformly charged by a charging means 29 such as a corona charging apparatus to a polarity opposite to that which the charge transport material is capable of transporting. As illustrated schematically in FIGS. 14A and 14B, the charged member is then exposed imagewise to light radiation 51 in the spectral region where the migration marking material is most photosensitive. In the illustrated embodiment, wherein the migration marking material comprises selenium particles, the radiation is within the blue/green wavelength range. Absorption of the blue/green light results in the migration marking particles gaining a net negative charge in the exposed region. In the unexposed region, the migration marking particles remain uncharged. As illustrated schematically in FIGS. 15A and 15B, the imaging member is subsequently developed by causing the softenable material to soften by any suitable means, such as uniform application of heat energy 33. The exposed and charged migration marking particles migrate toward the substrate and disperse in the softenable layer, resulting in a $D_{min}$ region. The unexposed uncharged migration marking particles remain in the original monolayer configuration, resulting in a $D_{max}$ region. Thus the resulting migration image is an optically sign-retained image. The imaged and developed migration imaging member can also be used as a xeroprinting printing master using the process as illustrated schematically in FIGS. 9A and 9B to 12A and 12B.

The present invention provides infrared or red light sensitive imaging members and imaging processes for imaging the members and for using the imaged members as a xeroprinting master. The ability to image the member with infrared or red light radiation enables the use of the member in laser imaging systems employing relatively inexpensive diode lasers. The xeroprinting master produced in accordance with the present invention provides high contrast voltage and electrical cycling stability. Unlike some conventional xeroprinting masters, the master utilized in the xeroprinting system of this invention can be uniformly charged to its full potential because the entire imaging surface is generally insulating (i.e. no insulating patterns on a metal conductor where fringing fields from the insulating areas repel incoming corona ions to the adjacent conductive areas). This yields electrostatic images of high contrast potential and high resolution on the master. Thus high quality prints having high contrast density and high resolution are obtained. In addition, unlike many prior art electronic and/or xerographic printing techniques employing a conventional photoreceptor, such as conventional laser xerography in which the imagewise exposure step must be repeated for each print, the imagewise exposure step need only be performed once to produce the xeroprinting master for this invention from which multiple prints can be produced at high speed. Thus the xeroprinting system of this invention surmounts the fundamental electronic bandwidth problem which prevents a conventional xerographic approach to very high quality, high speed electronic black-and-white or color printing. Accordingly, the combined capabilities of high photosensitivity, high quality, and high printing speed at reasonable cost make the xeroprinting system of this invention suitable for both high quality color proofing and for printing/duplicating applications. Compared with offset printing, the xeroprinting system of this invention offers the advantages of lower master costs (no need for separate lithographic intermediate and printing plates). Intermediates are needed in offset printing because the printing plates are not photosensitive enough to be imaged directly; instead, the printing plates are contact exposed to the intermediate using strong UV light, and then chemically developed. Another advantage of the present invention is that it eliminates the need of using totally different printing technologies for color proofing and printing as required by prior art techniques, and the end users can be reliably assured of the desired print quality before a large number of prints is made. Therefore, the xeroprinting system of this invention is also less costly than other known systems. By separating the film structure into different layers, the imaging member of the present invention allows maximum flexibility in selecting appropriate materials to maximize its mechanical, chemical, electrical, imaging, and xeroprinting properties. The xeroprinting master employed for the present invention is formed as a result of permanent structural changes in the migration marking material in the softenable layer without removal and disposal of any components from the softenable layer. Thus, because of its unique imaging characteristics, the xeroprinting master used in the xeroprinting system of this invention offers the combined advantages of simple fabrication, lower costs, high photosensitivity (laser sensitivity), dry, fast, and simple master preparation with no effluents, high quality, high resolution, and high printing speed. Therefore, applications for this xeroprinting system include various types of printing systems such as high quality color printing and proofing.

If heat development is used, the master making process of the present invention is totally dry, exceedingly simple (merely corona charging, imagewise exposure and heat development), and can be accomplished in a matter of seconds. Thus it is possible to configure a master-maker to utilize this process which can function either as a stand-alone unit or which can easily be integrated into a xeroprinting press to form a self-contained fully automated printing system suitable for use even in office environments. Because the xeroprinting master precursor member exhibits high photosensitivity and high resolution, computer-driven electronic writing techniques such as laser scanning can be advantageously used to create high resolution image (line or pictorial) on the xeroprinting master for xeroprinting. Therefore, in conjunction with its capabilities of high quality, high resolution, and high printing speed, a xeroprinting system of the present invention can deliver the full advantages of computer technology from the digital file input (text editing, composition, pagination, image manipulations, and the like) directly to the printing process to produce prints having high quality and high resolution at high speed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An infrared sensitive migration imaging member was prepared as follows. A solution for the softenable layer was prepared by dissolving about 34 grams of a terpolymer of styrene/ethylacrylate/acrylic acid (obtained from Desoto Company as E-335) and about 16 grams of N,N'-diphenyl-N,N'-bis(3''-methylphenyl)-(1,1'-biphenyl)-4,4'-diamine (prepared as disclosed in U.S. Pat. No. 4,265,990, the disclosure of which is totally incorporated herein by reference) in about 450 grams of toluene. N,N'-diphenyl-N,N'-bis(3''-methylphenyl)-(1,1'-biphenyl)-4,4'-diamine is a charge transport material capable of transporting positive charges (holes). The resulting solution was coated by a solvent extrusion technique onto a polyester substrate (Melinex 442, obtained from Imperial Chemical Industries (ICI), aluminized to 20 percent light transmission), and the deposited softenable layer was allowed to dry at about 115° C. for about 2 minutes, resulting in a dried softenable layer with a thickness of about 8 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer was formed.

A dispersion for the infrared sensitive layer was then prepared by mixing about 4.5 grams of an infrared sensitive organic pigment of chloroindium phthalocyanine (prepared by the reaction disclosed in "Studies of a Series of Haloaluminum, Gallium, and Indium Phthalocyanines," *Inorganic Chemistry*, vol. 19, pages 3131 to 3135 (1980)), and about 4.5 grams of a polymer binder of polyvinyl butyral (Butvar 72, from Monsanto Co.) in about 200 grams of isobutanol solvent. The resulting mixture was then ball milled for 48 hours, and the prepared dispersion was then coated, using the technique of solvent extrusion, onto the imaging member prepared as described above. The deposited infrared-sensitive layer was allowed to dry at about 115° C. for about 2 minutes, resulting in a dried layer with a thickness of about 0.3 microns.

EXAMPLE II

An infrared sensitive migration imaging member was prepared as described in Example I. The member was uniformly positively charged to a surface potential of about +500 volts with a corona charging device and was subsequently exposed by placing a test pattern mask comprising a silver halide image in contact with the imaging member and exposing the member to infrared light of 780 nanometers through the mask. The exposed member was subsequently uniformly exposed to 490 nanometer light and thereafter uniformly negatively recharged to about −600 volts with a corona charging device. The imaging member was then developed by subjecting it to a temperature of about 110° C. for about 4 seconds using a hot plate in contact with the polyester. The resulting imaging member exhibited an optically sign-reversed image of high image quality, resolution in excess of 150 line pairs per millimeter, and an optical contrast density of about 0.6. The optical density of the $D_{max}$ area was about 1.6 and that of the $D_{min}$ area was about 1.0. The $D_{min}$ was due to substantial depthwise migration of the selenium particles toward the aluminum layer in the $D_{min}$ regions of the image. Particle migration occurred in the region that was not exposed to infrared light.

EXAMPLE III

An infrared-sensitive imaging prepared as described in Example I was processed using identical conditions to those described in Example II except that the process steps of the imagewise exposure to infrared light of 780 nanometers and the uniform exposure to 490 nanometer light were reversed in order. The resulting imaging member exhibited identical characteristics to those obtained in Example II.

EXAMPLE IV

The contrast voltage of the electrostatic latent image of an imaged and developed imaging member prepared as described in Example II was determined as follows. The developed imaging member was uniformly negatively charged to a surface potential of about −820 volts with a corona charging device and was subsequently uniformly exposed to 400 to 700 nanometer activating illumination of about 4,000 ergs/cm$^2$ to form an electrostatic latent image on the master. The surface voltage was about −700 volts in the $D_{max}$ areas and about −50 volts in the $D_{min}$ areas of the image. The contrast voltage for the electrostatic latent image on the master was −650 volts. The surface voltages were monitored with electrostatic voltmeters.

The process of uniform negative charging and uniform light exposure described above was then repeated 1,000 times using the imaged and developed imaging member. It was found that the surface voltage in the $D_{max}$ and $D_{min}$ areas remained stable for 1000 cycles.

EXAMPLE V

An imaged and developed imaging member prepared as described in Example II was used as a xeroprinting master as follows. The imaged and developed imaging member of the present invention was incorporated into the Xeroprinter ® 100, available from Fuji Xerox Company, Ltd., by replacing the original zinc oxide photoreceptor in the machine with the xeroprinting master. In addition, the incandescent flood exposure lamp in the machine was replaced with an 8 watt green fluorescent photoreceptor erase lamp (available from Fuji Xerox Company, Ltd. as #122P60205) as the flood exposure light source. The master was uniformly negatively charged to a potential of about −800 volts and then flood exposed to form an electrostatic latent image on the master surface. Subsequently, the latent image was developed with the black dry toner supplied with the Xeroprinter ® 100 machine and the developed image was transferred and fused to Xerox ® 4024 plain paper (11 inch × 17 inch size). The process was repeated at a printing speed of 50 copies per minute (about 15 inches per second), and was also repeated with the cyan and magenta dry toners supplied with the Xeroprinter ® 100. The images thus formed exhibited high image contrast, clear background, and an excellent halftone dot range of about 6 to about 95 percent. Over 100 prints were generated with the master with no apparent damage to the master and no degradation of image quality.

EXAMPLE VI

An infrared sensitive migration imaging member was prepared as described in Example I with the exception that the chloroindium phthalocyanine pigment was replaced with an X-form of metal free phthalocyanine pigment (prepared as described in U.S. Pat. No. 3,357,989 (Byrne et al.), column 3, lines 43 to 71, the entire disclosure of which patent is totally incorporated herein by reference). The resulting imaging member was imaged using the same processing steps as those of Example II. A high quality optically sign-reversed migration image of the original was obtained. The optical contrast density was about 0.62. The optical density of the $D_{max}$ area was about 1.67 and that of the $D_{min}$ area was about 1.05. The $D_{min}$ was due to substantial depthwise migration of the selenium particles toward the aluminum layer in the $D_{min}$ regions of the image. Particle migration occurred in the region that was not exposed to infrared light.

The developed imaging member was then uniformly negatively charged to a surface potential of about −800 volts with a corona charging device and was subsequently uniformly exposed to 400 to 700 nanometer activating illumination of about 4,000 ergs/cm$^2$ to form an electrostatic latent image on the master. The surface voltage was about −710 volts in the $D_{max}$ areas and about −70 volts in the $D_{min}$ areas of the image. The contrast voltage for the electrostatic latent image on the master was −640 volts. The surface voltages were monitored with electrostatic voltmeters.

EXAMPLE VII

An infrared sensitive migration imaging member was prepared as described in Example I with the exceptions that the chloroindium phthalocyanine was replaced with a chloro-aluminum phthalocyanine pigment (prepared by the reaction disclosed in "Studies of a Series of Haloaluminum, Gallium, and Indium Phthalocyanines," *Inorganic Chemistry*, vol. 19, pages 3131 to 3135 (1980)), the pigment to binder ratio was 30 percent pigment to 70 percent binder by total weight, and the thickness of softenable layer was about 4 microns. The resulting imaging member was imaged using the same processing steps as those of Example II. A high quality optically sign-reversed migration image of the original was obtained. The optical contrast density was about 0.60. The optical density of the $D_{max}$ area was about 1.80 and that of the $D_{min}$ area was about 1.20. The $D_{min}$ was due to substantial depthwise migration of the selenium particles toward the aluminum layer in the $D_{min}$ regions of the image. Particle migration occurred in the region that was not exposed to infrared light.

The developed imaging member was then uniformly negatively charged to a surface potential of about −400 volts with a corona charging device and was subsequently uniformly exposed to 400 to 700 nanometer activating illumination of about 7,000 ergs/cm$^2$ to form an electrostatic latent image on the master. The surface voltage was about −360 volts in the $D_{max}$ areas and about −160 volts in the $D_{min}$ areas of the image. The contrast voltage for the electrostatic latent image on the master was −200 volts. The surface voltages were monitored with electrostatic voltmeters.

EXAMPLE VIII

An infrared sensitive migration imaging member was prepared as described in Example I. The resulting imaging member was uniformly negatively charged to a surface potential of about −500 volts with a corona charging device and was subsequently exposed by placing a test pattern mask comprising a silver halide image in contact with the imaging member and exposing the member to 440 nanometers through the mask. The imaging member was then developed by subjecting it to a temperature of about 110° C. for about 4 seconds using a hot plate in contact with the polyester. The resulting imaging member exhibited an optically sign-retained image of high image quality, resolution in excess of 150 line pairs per millimeter, and an optical contrast density of about 0.9. The optical density of the $D_{max}$ area was about 1.9 and that of the $D_{min}$ area was about 1.0. The $D_{min}$ was due to substantial depthwise migration of the selenium particles toward the aluminum layer in the $D_{min}$ regions of the image. Particle migration occurred in the region that was exposed to blue light.

The developed imaging member was then uniformly negatively charged to a surface potential of about −800 volts with a corona charging device and was subsequently uniformly exposed to 400 to 700 nanometer activating illumination of about 4,000 ergs/cm$^2$ to form an electrostatic latent image on the master. The surface voltage was about −760 volts in the $D_{max}$ areas and about −30 volts in the $D_{min}$ areas of the image. The contrast voltage for the electrostatic latent image on the master was −730 volts. The surface voltages were monitored with electrostatic voltmeters.

The electrostatic latent image thus formed was then be developed with a liquid electrostatic developer comprising 98 percent by weight Isopar® L (an isoparaffinic hydrocarbon available from Exxon Corporation), 2 percent by weight of carbon black pigmented polyethylene acrylic acid resin, and a basic barium petronate (available from Witco Inc. charge control additive, followed by transfer and fusing of the deposited toner image to a sheet of paper to result in a high quality print.

EXAMPLE IX

Into 97.5 grams of cyclohexanone (analytical reagent grade, obtained from British Drug House (BDH)) was dissolved 1.75 grams of Butvar B-72, a polyvinylbutyral resin (obtained from Monsanto Plastics & Resins Co.). To the solution was added 0.75 grams of benzimidazole perylene (prepared according to the method set forth in U.S. Pat. No. 4,587,189 (Hor et al.), column 12, lines 5 to 20, the entire disclosure of which patent is totally incorporated herein by reference) and 100 grams of ⅛ inch diameter stainless steel balls. The dispersion (containing 2.5 percent by weight solids) was ball milled for 24 hours and then hand coated with a #4 wire wound rod onto a 4 mil thick conductive substrate comprising aluminized polyester (Melinex 442, obtained from Imperial Chemical Industries (ICI), aluminized to 20 percent light transmission). After the material was dried on the substrate at about 80° C. for about 20 seconds, the film thickness of the resulting pigment-containing layer was about 0.1 micron.

Subsequently, a solution of 20 percent by weight solids styrene/ethyl acrylate/acrylic acid terpolymer (prepared according to the method set forth in U.S. Pat. No. 4,853,307 (Tam et al.), column 40, line 65 to column 41, line 18, the entire disclosure of which patent is totally incorporated herein by reference) in spectro grade toluene (obtained from Caledon Laboratories) was hand coated onto the pigment-containing layer with a #16 wire wound rod. After drying at 80° C. for about 20 seconds, a thermoplastic softenable layer about 5 microns thick resulted.

The coated substrate was then maintained at 115° C. in a chamber evacuated to $1\times10^{-4}$ torr and selenium was evaporated onto the heated thermoplastic softenable layer at 55 micrograms per square centimeter to form a closely packed monolayer structure of selenium particles of about 0.3 microns in diameter just below the surface of the thermoplastic softenable layer.

The migration imaging member thus formed was then uniformly charged negatively to about −500 volts with a corotron, followed by imagewise exposure to light at 660 nanometer wavelength at an energy level of about 25 ergs per square centimeter, followed by flood exposure to blue light at 440 nanometers wavelength. The exposed member was then heat developed for about 3 seconds at 115° C. by contacting the uncoated surface of the Melinex substrate to a heated roll. A sharp negative image of the original exposure image with an optical contrast density of 1.0 in the blue region was obtained.

EXAMPLE X

A migration imaging member was prepared as described in Example IX with the exception that X-metal free phthalocyanine (prepared as described in U.S. Pat. No. 3,357,989 (Byrne et al.), column 3, lines 43 to 71) was substituted for the benzimidazole perylene pigment and with the exception that the thermoplastic softenable layer comprised 84 percent by weight of the terpolymer and 16 percent by weight of the hole transporting diamine N,N' diphenyl-N,N'-bis(3''-methylphenyl)-(1,1'-biphenyl)-4,4'-diamine (prepared as described in U.S. Pat. No. 4,265,990). The processing steps to produce a migration image were the same as those of Example IX with the exception that 50 ergs per square centimeter of light at 780 nanometer wavelength was used for the imagewise exposure step. A sharp negative image of the original exposure image with an optical contrast density of 1.05 in the blue region was obtained.

EXAMPLE XI

A migration imaging member was prepared as described in Example IX with the exception that the benzimidazole perylene pigment was not dissolved in a polymeric binder for solution coating, but was placed onto the Melinex substrate as a vacuum evaporated layer. The pigment was heated to a temperature of 600° C. and the substrate was maintained at room temperature during the deposition to a thickness of 0.1 micron under a vacuum of $1\times10^{-5}$ torr. The processing steps to produce a migration image were the same as those of Example IX, resulting in a sharp negative image of the original exposure image with an optical contrast density of 1.01 in the blue region.

EXAMPLE XII

A migration imaging member was prepared as described in Example X with the exception that the X-metal free phthalocyanine pigment was not dissolved in a polymeric binder for solution coating, but was placed onto the Melinex substrate as a vacuum evaporated layer. The pigment was heated to a temperature of 490° C. and the substrate was maintained at room temperature during the deposition to a thickness of 0.1 micron under a vacuum of $1\times10^{-5}$ torr. The processing steps to produce a migration image were the same as those of Example X with the exception that 60 ergs per square centimeter of light at 660 nanometer wavelength was used for the imagewise exposure step. A sharp negative image of the original exposure image with an optical contrast density of 0.98 in the blue region was obtained.

EXAMPLE XIII

A migration imaging member was prepared as described in Example X with the exception that the pigment and binder amounts in the pigmented layer were changed to 50 percent by weight X-metal free phthalocyanine pigment and 50 percent by weight polyvinylbutyral resin (instead of 30 percent by weight X-metal free phthalocyanine pigment and 70 percent by weight polyvinylbutyral resin).

The migration imaging member thus formed was then uniformly charged negatively to about −500 volts with a corotron, followed by imagewise exposure to light at 780 nanometer wavelength at an energy level of about 50 ergs per square centimeter, followed by flood exposure to blue light at 440 nanometers wavelength. The exposed member was then heat developed for about 3 seconds at 115° C. by contacting the uncoated surface of the Melinex substrate to a heated roll. A sharp negative image of the original exposure image with an optical contrast density of 1.05 in the blue region was obtained.

EXAMPLE XIV

An infrared-sensitive imaging member was prepared by mixing about 4.5 grams of an infrared sensitive organic pigment of X-form of metal free phthalocyanine (prepared as described in U.S. Pat. No. 3,357,989 (Byrne et al.), column 3, lines 43 to 71) and about 10.5 grams of a polymer binder of polyvinyl butyral (Butvar 72, from Monsanto Co.) in about 485 grams of isobutanol solvent. The resulting mixture was then ball milled for 48 hours, and the prepared dispersion was then coated, using the technique of solvent extrusion, onto a 12 inch wide 100 micron (4 mil) thick Mylar® polyester film (available from E. I. Du Pont de Nemours & Company) having a thin, semi-transparent aluminum coating. The deposited infrared-sensitive layer was allowed to dry at about 115° C. for about 2 minutes, resulting in a dried layer with a thickness of about 0.2 microns. A solution for the softenable layer was then prepared by dissolving about 34 grams of a terpolymer of styrene/ethylacrylate/acrylic acid (obtained from Desoto Company as E-335) and about 16 grams of N,N'-diphenyl-N,N'-bis(3''-methylphenyl)-(1,1'-biphenyl)-4,4'-diamine (prepared as disclosed in U.S. Pat. No. 4,265,990) in about 450 grams of toluene. N,N'-diphenyl-N,N'-bis(3''-methylphenyl)-(1,1'-biphenyl)-4,4'-diamine is a charge transport material capable of transporting positive charges (holes). The resulting solution was coated by a solvent extrusion technique onto the infrared sensitive layer and the deposited softenable layer was allowed to dry at about 115° C. for about 2 minutes, resulting in a dried softenable layer with a thickness of about 6 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer was formed.

EXAMPLE XV

An infrared-sensitive imaging prepared as described in Example XIV was uniformly negatively charged to a surface potential of about −600 volts with a corona charging device and was subsequently exposed by placing a test pattern mask comprising a silver halide image in contact with the imaging member and exposing the member to infrared light of 780 nanometers through the mask. The exposed member was subsequently uniformly exposed to 400 nanometer light and thereafter developed by subjecting it to a temperature of about 115° C. for about 5 seconds using a hot plate in contact with the polyester. The resulting imaging member exhibited an optical contrast density of about 1.0. The optical density of the $D_{max}$ area was about 1.9 and that of the $D_{min}$ area was about 0.9. The $D_{min}$ was due to substantial depthwise migration of the selenium particles toward the aluminum layer in the $D_{min}$ regions of the image.

EXAMPLE XVI

An infrared-sensitive imaging prepared as described in Example XIV was processed using identical conditions to those described in Example XV except that the process steps of the imagewise exposure to infrared light of 780 nanometers and the uniform exposure to 400 nanometer light were reversed in order. The resulting imaging member exhibited identical characteristics to those obtained in Example XV.

EXAMPLE XVII

A red-sensitive imaging member was prepared by mixing about 4.5 grams of a red sensitive organic pigment of benzimidazole perylene (prepared according to the method set forth in U.S. Pat. No. 4,587,189 (Hor et al.), column 12, lines 5 to 20) and about 10.5 grams of a polymer binder of polyvinyl butyral (Butvar 72, from Monsanto Co.) in about 485 grams of isobutanol solvent. The resulting mixture was then ball milled for 48 hours, and the prepared dispersion was then coated, using the technique of solvent extrusion, onto a 12 inch wide 100 micron (4 mil) thick Mylar® polyester film (available from E. I. Du Pont de Nemours & Company) having a thin, semi-transparent aluminum coating and the deposited red-sensitive layer was allowed to dry at about 115° C. for about 2 minutes, resulting in a dried layer with a thickness of about 0.2 microns. A solution for the softenable layer was then prepared by dissolving about 34 grams of a terpolymer of styrene/ethylacrylate/acrylic acid (obtained from Desoto Company as E-335) and about 16 grams of N,N'-diphenyl-N,N'-bis(-3''-methylphenyl)-(1,1'-biphenyl)-4,4'-diamine (prepared by the method disclosed in U.S. Pat. No. 4,265,990) in about 450 grams of toluene. The N,N'-diphenyl-N,N'-bis(3''-methylphenyl)-(1,1'-biphenyl)-4,4'-diamine is a charge transport material capable of transporting positive charges (holes). The resulting solution was coated by solvent extrusion technique onto the infrared sensitive layer and the deposited softenable layer was allowed to dry at about 115° C. for about 2 minutes, resulting in a dried softenable layer with a thickness of about 6 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the exposed surface of the copolymer was formed.

The prepared imaging member was uniformly negatively charged to a surface potential of about −600 volts with a corona charging device and was subsequently exposed by placing a test pattern mask comprising a silver halide image in contact with the imaging member and exposing the member to red light of 640 nanometer through the mask. The exposed member was subsequently uniformly exposed to 400 nanometer light and thereafter developed by subjecting it to a temperature of about 115° C. for about 5 seconds using a hot plate in contact with the polyester. The resulting imaging member exhibited an optical contrast density of about 0.85. The optical density of the $D_{max}$ area was about 2.0 and that of the $D_{min}$ area was about 1.15. The $D_{min}$ was due to substantial depthwise migration of the selenium particles toward the aluminum layer in the $D_{min}$ regions of the image.

EXAMPLE XVIII

An infrared-sensitive imaging member was prepared by vacuum sublimation of a X-form of metal free phthalocyanine (prepared as described in U.S. Pat. No. 3,357,989 (Byrne et al.), column 3, lines 43 to 71) placed in a crucible in a vacuum chamber. The temperature of the pigment was then raised to a temperature of about 550° C. to deposit it onto a 12 inch wide 100 micron (4 mil) thick Mylar® polyester film (available from E. I. Du Pont de Nemours & Company) having a thin, semitransparent aluminum coating, resulting in a vacuum deposited layer with a thickness of about 1,000 Angtroms. A solution for the softenable layer was then prepared by dissolving about 2 grams of a terpolymer of styrene/ethylacrylate/acrylic acid (obtained from Desoto Company as E-335), and about 8 grams of N,N'-diphenyl-N,N'-bis(3''-methylphenyl)-(1,1'-biphenyl)-4,4'-diamine (prepared by the method disclosed in U.S. Pat. No. 4,265,990) in about 450 grams of toluene. The N,N'-diphenyl-N,N'-bis(3''-methylphenyl)-(1,1'-biphenyl)-4,4'-diamine is a charge transport material capable of transporting positive charges (holes). The resulting solution was coated by solvent extrusion technique onto the infrared sensitive layer and the deposited softenable layer was allowed to dry at about 115° C. for about 2 minutes, resulting in a dried softenable layer with a thickness of about 6 micron. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the exposed surface of the copolymer was formed.

The prepared imaging member was uniformly negatively charged to a surface potential of about −600 volts with a corona charging device and was subsequently exposed by placing a test pattern mask comprising a silver halide image in contact with the imaging member and exposing the member to infrared light of 780 nanometers through the mask. The exposed member was subsequently uniformly exposed to 400 nanometer light and thereafter developed by subjecting it to a temperature of about 115° C. for about 5 seconds using a hot plate in contact with the polyester. The resulting imaging member exhibited an optical contrast density of about 1.0. The optical density of the $D_{max}$ area was about 1.9 and that of the $D_{min}$ area was about 0.9. The $D_{min}$ was due to substantial depthwise migration of the selenium particles toward the aluminum layer in the $D_{min}$ regions of the image.

EXAMPLE XIX

A red-sensitive imaging member was prepared by vacuum sublimation of benzimidazole perylene (prepared according to the method set forth in U.S. Pat. No. 4,587,189 (Hor et al.), column 12, lines 5 to 20) in a vacuum chamber onto a 12 inch wide 100 micron (4 mil) thick Mylar® polyester film (available from E. I. Du Pont de Nemours & Company) having a thin, semitransparent aluminum coating. The thickness of the vacuum-deposited layer was about 1,000 Angtroms. A solution for the softenable layer was then prepared by dissolving about 42 grams of a terpolymer of styrene/ethylacrylate/acrylic acid (obtained from Desoto Company as E-335), and about 8 grams of N,N'-diphenyl-N,N'-bis(3''-methylphenyl)-(1,1'-biphenyl)-4,4'-diamine (prepared as disclosed in U.S. Pat. No. 4,265,990) in about 450 grams of toluene. The N,N'-diphenyl-N,N'-bis(3''-methylphenyl)-(1,1'-biphenyl)-4,4'-diamine is a charge transport material capable of transporting positive charges (holes). The resulting solution was coated by solvent extrusion technique onto the red sensitive layer, and the deposited softenable layer was allowed to dry at about 115° C. for about 2 minutes, resulting in a dried softenable layer with a thickness of about 6 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the exposed surface of the copolymer was formed.

The prepared imaging member was uniformly negatively charged to a surface potential of about −600 volts with a corona charging device and was subsequently exposed by placing a test pattern mask comprising a silver halide image in contact with the imaging member and exposing the member to red light of 640 nanometers through the mask. The exposed member was subsequently uniformly exposed to 400 nanometer light and thereafter developed by subjecting it to a temperature of about 115° C. for about 5 seconds using a hot plate in contact with the polyester. The resulting imaging member exhibited an optical contrast density of about 1.0. The optical density of the $D_{max}$ area was about 2.0 and that of the $D_{min}$ area was about 1.0. The $D_{min}$ was due to substantial depthwise migration of the selenium particles toward the aluminum layer in the $D_{min}$ regions of the image.

EXAMPLE XX

An imaged and developed imaging member prepared as described in Example XV was used as a xeroprinting master as follows: The developed imaging member was uniformly positively charged to a surface potential of about +600 volts with a corona charging device and was subsequently uniformly exposed to 440 nanometer activating illumination of about 9 ergs/cm$^2$ to form an electrostatic latent image on the master. The surface voltage was about +160 volts in the $D_{max}$ areas and about +330 volts in the $D_{min}$ areas of the image. The surface voltages were monitored with electrostatic voltmeters.

The electrostatic latent image thus formed can then be developed with a liquid electrostatic developer followed by transfer of the deposited toner image to a sheet of paper and, if necessary, fusing. It is believed a high quality print will be obtained.

EXAMPLE XXI

An imaged and developed imaging member prepared as described in Example XV was used as a xeroprinting master as follows: The developed imaging member was uniformly negatively charged to a surface potential of about −600 volts with a corona charging device and was subsequently uniformly exposed to 440 nanometer activating illumination of about 20 ergs/cm$^2$ to form an electrostatic latent image on the master. The surface voltage was about 70 volts in the $D_{max}$ areas and about 180 volts in the $D_{min}$ areas of the image. The surface voltages were monitored with electrostatic voltmeters.

The electrostatic latent image thus formed can then be developed with a liquid electrostatic developer followed by transfer of the deposited toner image to a sheet of paper and, if necessary, fusing. It is believed a high quality print will be obtained.

Other embodiments and modifications of the present invention may occur to those skilled in the art subsequent to a review of the information presented herein; these embodiments and modifications, as well as equivalents thereof, are also included within the scope of this invention.

What is claimed is:

1. A migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is sensitive contained at or near the surface of the softenable layer.

2. An imaging member according to claim 1 wherein the infrared or red light radiation sensitive layer is situated between the substrate and the softenable layer.

3. An imaging member according to claim 1 wherein the softenable layer is situated between the substrate and the infrared or red light radiation sensitive layer.

4. An imaging member according to claim 1 wherein the migration marking material is selenium.

5. An imaging member according to claim 1 wherein the charge transport material is selected from the group consisting of diamine hole transport materials, pyrazoline hole transport materials, hydrazone hole transport materials, and mixtures thereof.

6. An imaging member according to claim 1 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

7. An imaging member according to claim 1 wherein the infrared or red light radiation sensitive layer contains a charge transport material.

8. A xeroprinting master which comprises a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, wherein a portion of the migration marking material has migrated through the softenable layer toward the substrate in imagewise fashion.

9. A xeroprinting master according to claim 8 wherein the infrared or red light radiation sensitive layer is situated between the substrate and the softenable layer.

10. A xeroprinting master according to claim 8 wherein the softenable layer is situated between the substrate and the infrared or red light radiation sensitive layer.

11. A xeroprinting master according to claim 8 wherein the migration marking material is selenium.

12. A xeroprinting master according to claim 8 wherein the charge transport material is selected from the group consisting of diamine hole transport materials, pyrazoline hole transport materials, hydrazone hole transport materials, and mixtures thereof.

13. A xeroprinting master according to claim 8 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

14. A xeroprinting master according to claim 8 wherein the infrared or red light radiation sensitive layer contains a charge transport material.

15. An imaging process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; and (5) subsequent to steps 3 and 4, causing the softenable material to soften, thereby enabling the migration marking material to migrate through the softenable material toward the substrate in an imagewise pattern.

16. A process according to claim 15 wherein the infrared or red light radiation sensitive layer is situated between the substrate and the softenable layer.

17. A process according to claim 15 wherein the softenable layer is situated between the substrate and the infrared or red light radiation sensitive layer.

18. A process according to claim 15 wherein subsequent to steps (3) and (4) and before step (5) the imaging member is uniformly recharged.

19. A process according to claim 18 wherein the recharging is to a polarity opposite to that to which the imaging member was charged in step (2).

20. A process according to claim 18 wherein the recharging is to a polarity the same as that to which the imaging member was charged in step (2).

21. A process according to claim 15 wherein step (3) takes place before step (4).

22. A process according to claim 15 wherein step (4) takes place before step (3).

23. A process according to claim 15 wherein the migration marking material is selenium.

24. A process according to claim 15 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

25. A process according to claim 15 wherein the softenable material is caused to soften by the application of heat.

26. A process according to claim 15 wherein the infrared or red light radiation sensitive layer contains a charge transport material.

27. A xeroprinting process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is sensitive contained at or near the surface of the softenable layer; (2) uniformly charging the imaging member; (3) subsequent to step 2, exposing the charged imaging member to infrared or red light radiation at a wavelength to which the infrared or red light radiation sensitive pigment is sensitive in an imagewise pattern, thereby forming an electrostatic latent image on the imaging member; (4) subsequent to step 2, uniformly exposing the imaging member to activating radiation at a wavelength to which the migration marking material is sensitive; (5) subsequent to steps 3 and 4, causing the softenable material to soften, thereby enabling the migration marking material to migrate through the softenable material toward the substrate in an imagewise pattern; (6) subsequent to step 5, uniformly charging the developed imaging member; (7) subsequent to step 6, uniformly exposing the charged developed member to activating radiation, thereby forming an electrostatic latent image; (8) subsequent to step 7, developing the electrostatic latent image; and (9) subsequent to step 8, transferring the developed image to a receiver sheet.

28. A process according to claim 27 wherein the infrared or red light radiation sensitive layer is situated between the substrate and the softenable layer.

29. A process according to claim 27 wherein the softenable layer is situated between the substrate and the infrared or red light radiation sensitive layer.

30. A process according to claim 27 wherein subsequent to steps (3) and (4) and before step (5) the imaging member is uniformly recharged.

31. A process according to claim 30 wherein the recharging is to a polarity opposite to that to which the imaging member was charged in step (2).

32. A process according to claim 30 wherein the recharging is to a polarity the same as that to which the imaging member was charged in step (2).

33. A process according to claim 27 wherein step (3) takes place before step (4).

34. A process according to claim 27 wherein step (4) takes place before step (3).

35. A process according to claim 27 wherein the migration marking material is selenium.

36. A process according to claim 27 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

37. A process according to claim 27 wherein the softenable material is caused to soften by the application of heat.

38. A process according to claim 27 wherein the imaging member is uniformly charged to one polarity in step (2) and is uniformly charged to the opposite polarity in step (6).

39. A process according to claim 27 wherein the imaging member is uniformly charged to one polarity in step (2) and is uniformly charged to the same polarity in step (6).

40. A process according to claim 27 wherein the infrared or red light radiation sensitive layer contains a charge transport material.

41. An imaging process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to radiation at a wavelength to which the migration marking material is sensitive in an imagewise pattern, thereby forming an electrostatic latent image on the imaging member; and (4) subsequent to step 3, causing the softenable material to soften, thereby enabling the migration marking material to migrate through the softenable material toward the substrate in an imagewise pattern.

42. A process according to claim 41 wherein the infrared or red light radiation sensitive layer is situated between the substrate and the softenable layer.

43. A process according to claim 41 wherein the softenable layer is situated between the substrate and the infrared or red light radiation sensitive layer.

44. A xeroprinting process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer; (2) uniformly charging the imaging member; (3) subsequent to step 2, exposing the charged imaging member to radiation at a wavelength to which the migration marking material is sensitive in an imagewise pattern, thereby forming an electrostatic latent image on the imaging member; (4) subsequent to step 3, causing the softenable material to soften, thereby enabling the migration marking material to migrate through the softenable material toward the substrate in an imagewise pattern; (5) subsequent to step 4, uniformly charging the imaging member; (6) subsequent to step 5, uniformly exposing the charged member to activating radiation, thereby forming an electrostatic latent image; (7) subsequent to step 6, developing the electrostatic latent image; and (8) subsequent to step 7, transferring the developed image to a receiver sheet.

45. A process according to claim 44 wherein the infrared or red light radiation sensitive layer is situated between the substrate and the softenable layer.

46. A process according to claim 44 wherein the softenable layer is situated between the substrate and the infrared or red light radiation sensitive layer.

* * * * *